US009263052B1

(12) United States Patent
Talkin

(10) Patent No.: US 9,263,052 B1
(45) Date of Patent: Feb. 16, 2016

(54) SIMULTANEOUS ESTIMATION OF FUNDAMENTAL FREQUENCY, VOICING STATE, AND GLOTTAL CLOSURE INSTANT

(71) Applicant: GOOGLE INC., Mountain View, CA (US)

(72) Inventor: David Talkin, Monroe, VA (US)

(73) Assignee: Google Inc., Mountain View, CA (US)

( * ) Notice: Subject to any disclaimer, the term of this patent is extended or adjusted under 35 U.S.C. 154(b) by 450 days.

(21) Appl. No.: 13/750,000

(22) Filed: Jan. 25, 2013

(51) Int. Cl.
*G10L 13/00* (2006.01)
*G10L 13/06* (2013.01)
*G10L 19/04* (2013.01)

(52) U.S. Cl.
CPC ..... *G10L 19/04* (2013.01)

(58) Field of Classification Search
CPC ..... G10L 19/04; G10L 13/02; G10L 13/00; G10L 13/06
USPC ..... 704/205, 265, 220
See application file for complete search history.

(56) References Cited

U.S. PATENT DOCUMENTS 5,138,661 A * 8/1992 Zinser ..... G10L 13/02 704/219
6,073,093 A * 6/2000 Zinser, Jr. ..... G10L 19/09 704/219
2004/0059568 A1* 3/2004 Talkin ..... G10L 13/07 704/205
2012/0265534 A1* 10/2012 Coorman ..... G10L 13/033 704/265

OTHER PUBLICATIONS

Naylor et al., "Estimation of Glottal Closure Instants in Voiced Speech Using the DYPSA Algorithm", IEEE, Jan. 2007, pp. 34-43.*
Vincent et al., "Glottal Closure Instant Estimation Using an Appropriateness Measure of the Source and Continuity Constraints", IEEE, 2006, pp. 381-384.*
Talkin, "A Robust Algorithm for Pitch Tracking (RAPT)", Chap. 14 in "Speech Coding and Synthesis", Elsevier Science Inc., 1996, pp. 495-518.*
Arslan, "Speaker Transformation Algorithm using Segmental Codebooks (STASC)", Speech Communication 28, 1999, pp. 211-226.*
Drugman et al., "Detection of Glottal Closure Instants From Speech Signals: A Quantitative Review", IEEE, Mar. 2012, vol. 20, No. 3, pp. 994-1006.*
Saito, "On the Use of F0 Features in Automatic Segmentation for Speech Synthesis", ICSLP, 1998.*

(Continued)

*Primary Examiner* — Pierre-Louis Desir
*Assistant Examiner* — Seong Ah A Shin
(74) *Attorney, Agent, or Firm* — McDonnell Boehnen Hulbert & Berghoff LLP

(57) ABSTRACT

A method and system is disclosed for simultaneously determining glottal closure instants (GCIs), fundamental frequency (F0s), and voicing state of a speech signal. A speech signal may be processed to determine a sequence of candidate GCIs. For each candidate GCI, a set of candidate F0s may be determined. A lattice of hypotheses may be constructed, where each lattice point is a hypothesis of a concurrence of a candidate GCI, a candidate F0, and voicing state. Each given hypothesis may also include a score of the candidate GCI, F0, and voicing state for evaluating a cost of the given hypothesis and a cost of connections between the given hypothesis and other hypotheses of the lattice. Dynamic programming may be used to determine a least-cost path through the lattice, and backtracking across the path may be used to determine an optimal set of GCIs, F0s and voicing states of the speech signal.

19 Claims, 9 Drawing Sheets

(56) References Cited

OTHER PUBLICATIONS

Kotnik et al., "Noiserobust F0 determinationandepoch-markingalgorithms", Signal Processing 89, 2009, pp. 2555-2569.*
Arslan et al., "Voice Conversion by Codebook Mapping of Line Spectral Frequencies and Excitation Spectrum", Eurospeech. 1997.*
Ney, "Dynamic Programming Algorithm for Optimal Estimation of Speech Parameter Contours", IEEE, 1983, pp. 208-214.*
Talkin et al., "Pitch-Synchronous Analysis and Synthesis for TTS Systems", ESCA workshop on speech synthesis,1990, pp. 55-58.*
Talkin, David, "A Robust Algorithm for Pitch Tracking (RAPT)," chapter 14 in "Speech Coding and Synthesis," ed. W.B. Kleijn and K.K. Paliwal, Elsevier Science Inc., New York, NY, 1995, pp. 495-518.

* cited by examiner

SIMULTANEOUS ESTIMATION OF FUNDAMENTAL FREQUENCY, VOICING STATE, AND GLOTTAL CLOSURE INSTANT

BACKGROUND

Unless otherwise indicated herein, the materials described in this section are not prior art to the claims in this application and are not admitted to be prior art by inclusion in this section.

A goal of speech analysis is to determine characteristics of a speech signal that may be related to physiological properties of speech production. Such characteristics may have application in processes or operations involving speech synthesis, speech recognition, and speech encoding, possibly among others. Various technologies, including computers, network servers, telephones, and personal digital assistants (PDAs), can be employed to implement a speech analysis system, or one or more components of such a system. Communication networks may in turn provide communication paths and links between some or all of such devices, supporting speech analysis system capabilities, and services that may utilize speech analysis system capabilities.

BRIEF SUMMARY

In one aspect, an example embodiment presented herein provides, a method comprising: receiving, by a system including one or more processors, a speech signal comprising a first temporal sequence of speech-signal samples, each speech-signal sample having a sample time; processing the received speech signal with the one or more processors to determine (i) a second temporal sequence of candidate glottal closure instants (GCIs), each candidate GCI corresponding to a respective sample time in the first temporal sequence, (ii) for each respective candidate GCI of the second temporal sequence, a respective set of candidate fundamental frequencies (F0s) of the speech signal at the respective sample time corresponding to the respective candidate GCI, and (iii) for each respective candidate GCI of the second temporal sequence, a metric of voicing degree of the speech signal at the respective sample time corresponding to the respective candidate GCI; for each respective candidate GCI of the second temporal sequence, determining an objective function for each respective candidate F0 of the respective set, wherein the objective function comprises a respective hypothesis of a concurrence of all three of the respective candidate GCI, the respective candidate F0, and a voicing state of the speech signal, and wherein the respective hypothesis includes a GCI-period score for a correspondence between the respective candidate F0 and a subsequent candidate GCI of the second temporal sequence; for each respective candidate GCI of the second temporal sequence, determining a cost for each respective hypothesis based, at least, on both the GCI-period score and the metric of voicing degree at the respective sample time corresponding to the respective candidate GCI; determining a sequence of hypotheses corresponding to a least-cost path through the candidate GCIs, wherein the sequence of hypotheses includes at most one respective hypothesis associated with each candidate GCI; and backtracking through the least-cost path to determine a cost-optimal set of GCIs of the received speech signal.

In another aspect, an example embodiment presented herein provides, a system comprising: one or more processors; memory; and machine-readable instructions stored in the memory, that upon execution by the one or more processors cause the system to carry out operations comprising: receiving a speech signal comprising a first temporal sequence of speech-signal samples, wherein each speech-signal sample has a sample time, processing the received speech signal to determine (i) a second temporal sequence of candidate glottal closure instants (GCIs), wherein each candidate GCI corresponds to a respective sample time in the first temporal sequence, (ii) for each respective candidate GCI of the second temporal sequence, a respective set of candidate fundamental frequencies (F0s) of the speech signal at the respective sample time corresponding to the respective candidate GCI, and (iii) for each respective candidate GCI of the second temporal sequence, a metric of voicing degree of the speech signal at the respective sample time corresponding to the respective candidate GCI, for each respective candidate GCI of the second temporal sequence, determining an objective function for each respective candidate F0 of the respective set, wherein the objective function comprises a respective hypothesis of a concurrence of all three of the respective candidate GCI, the respective candidate F0, and a voicing state of the speech signal, and wherein the respective hypothesis includes a GCI-period score for a correspondence between the respective candidate F0 and a subsequent candidate GCI of the second temporal sequence, for each respective candidate GCI of the second temporal sequence, determining a cost for each respective hypothesis based, at least, on both the GCI-period score and the metric of voicing degree at the respective sample time corresponding to the respective candidate GCI, determining a sequence of hypotheses corresponding to a least-cost path through the candidate GCIs, wherein the sequence of hypotheses includes at most one respective hypothesis associated with each candidate GCI; and backtracking through the least-cost path to determine a cost-optimal set of GCIs of the received speech signal.

In still another aspect, an article of manufacture including a computer-readable storage medium, having stored thereon program instructions that, upon execution by one or more processors of a system, cause the system to perform operations comprising: receiving a speech signal comprising a first temporal sequence of speech-signal samples, each speech-signal sample having a sample time; processing the received speech signal to determine (i) a second temporal sequence of candidate glottal closure instants (GCIs), wherein each candidate GCI corresponds to a respective sample time in the first temporal sequence, (ii) for each respective candidate GCI of the second temporal sequence, a respective set of candidate fundamental frequencies (F0s) of the speech signal at the respective sample time corresponding to the respective candidate GCI, and (iii) for each respective candidate GCI of the second temporal sequence, a metric of voicing degree of the speech signal at the respective sample time corresponding to the respective candidate GCI; for each respective candidate GCI of the second temporal sequence, determining an objective function for each respective candidate F0 of the respective set, wherein the objective function comprises a respective hypothesis of a concurrence of all three of the respective candidate GCI, the respective candidate F0, and a voicing state of the speech signal, and wherein the respective hypothesis includes a GCI-period score for a correspondence between the respective candidate F0 and a subsequent candidate GCI of the second temporal sequence; for each respective candidate GCI of the second temporal sequence, determining a cost for each respective hypothesis based, at least, on both the GCI-period score and the metric of voicing degree at the respective sample time corresponding to the respective candidate GCI; determining a sequence of hypotheses corresponding to a least-cost path through the candidate GCIs, wherein the sequence of hypotheses includes at most one respective hypothesis associated with each candidate GCI;

and backtracking through the least-cost path to determine a cost-optimal set of GCIs of the received speech signal.

These as well as other aspects, advantages, and alternatives will become apparent to those of ordinary skill in the art by reading the following detailed description, with reference where appropriate to the accompanying drawings. Further, it should be understood that this summary and other descriptions and figures provided herein are intended to illustrative embodiments by way of example only and, as such, that numerous variations are possible. For instance, structural elements and process steps can be rearranged, combined, distributed, eliminated, or otherwise changed, while remaining within the scope of the embodiments as claimed.

DETAILED DESCRIPTION

1. Overview

Figure 1:
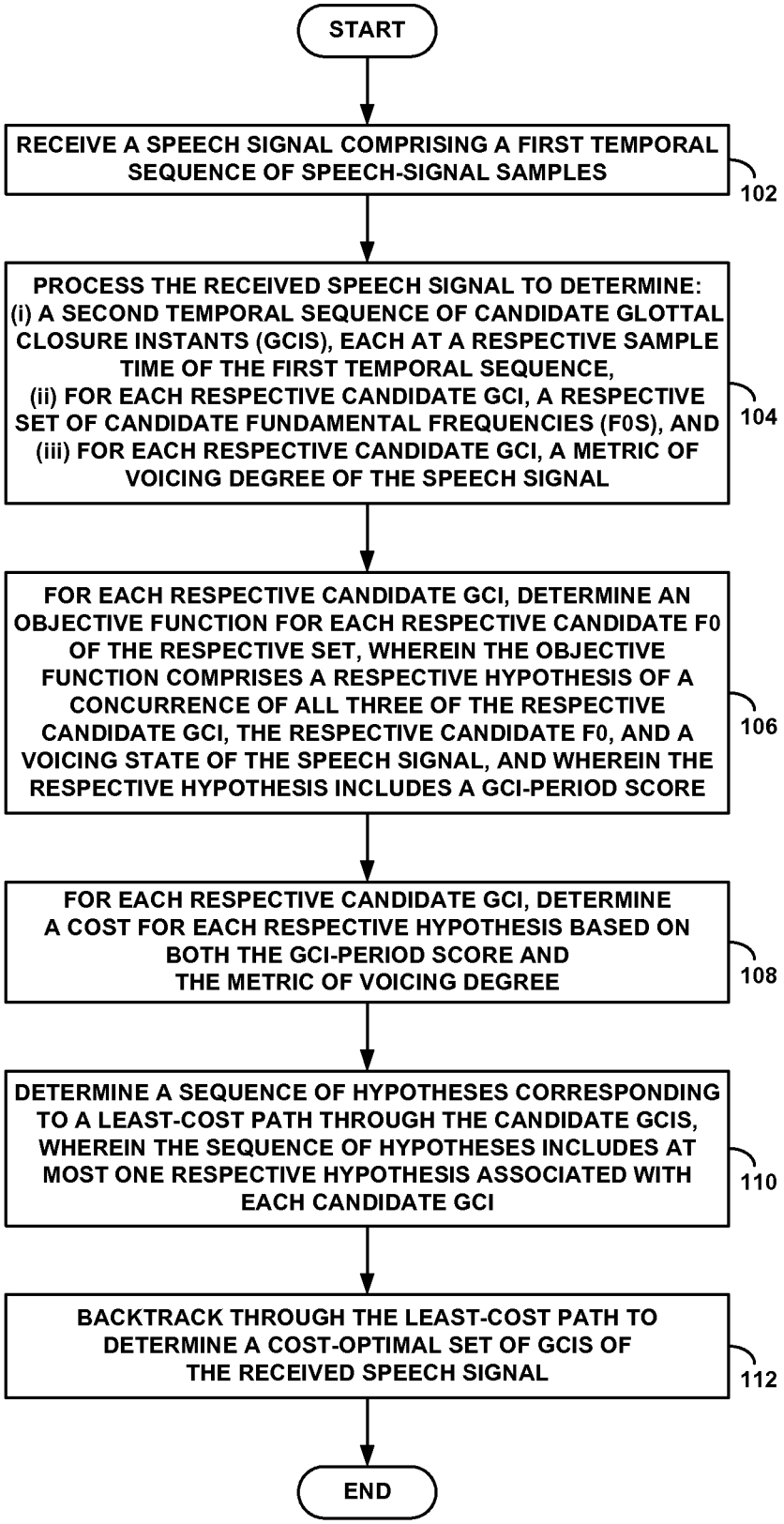
FIG. 1 is a flowchart illustrating an example method in accordance with an example embodiment.

The physiology of speech production involves a dynamic mechanical process of airflow from the lungs, through the vocal tract, and ultimately out of the mouth through the lips. Along the way, the airflow may be modulated by physical adjustments at various points in the vocal tract and at various times during the flow, resulting, for example, in temporally-varying resonant frequencies and amplitudes that combine to shape the air flow into speech. While the physical-mechanical processes of the vocal tract are well studied and understood, the ability to accurately and reliably identify signatures of certain physical speech-production characteristics in a speech signal remains a challenge. At the same time, the need for automatic, reliable estimates of speech-production characteristics from speech signals can have wide-ranging practical applicability in areas including speech synthesis, narrow-band speech encoding, and medical diagnostics, to name a few.

More particularly, accurate automatic estimates of speech-production characteristics related to airflow through the larynx can be of both practical and theoretical interest. As is known, airflow into and through the larynx is controlled by the "glottal opening," or "glottis," which is adjustable by the "vocal folds," known in the vernacular as the "vocal cords." As air flows through the glottis at a volume rate generally dependent on pulmonary effort and the degree of the glottal opening, the vocal folds oscillate at a frequency and amplitude further dependent on the tension and stiffness of the vocal folds. The oscillation varies the degree of the glottal opening, which then modulates the volume of air passing through the glottis and results in periodic airflow modulation that serves as excitation for the vocal tract during what is referred to as "voiced speech." The periodicity of voiced speech is characterized by a relatively abrupt closure of the glottis followed by a more gradual opening, a subsequent abrupt closure, and so on. Each moment in time when the glottis closes is called the "glottal closure instant" or "GCI," and marks the start of a "closed glottis cycle." Accurate and reliable identification of GCIs from analysis of a speech signal would be of interest in practical applications.

Another characteristic of speech production that can similarly be of interest is fundamental frequency F0. While F0 may be related to frequencies present in the spectrum of a speech signal, in practice it tends to be a nonlinear function of a speech signal's spectral and temporal energy distribution. As a result, automatic analytical determination of F0 from a speech signal can be a challenging task. It may be noted that the term "pitch" is sometimes used in reference to F0. However, while F0 may be defined operationally, pitch may be more properly described in terms of listener perception of tonal agreement of pure sinusoid with a complex speech signal, and its determination may therefore be at least partially subjective. Accordingly, the term "pitch tracking" as used in the vernacular may be considered as encompassing some technical imprecision when applied to determination of F0.

When airflow is forced through the vocal tract with sufficient velocity to generate significant turbulence, the result can be "unvoiced speech." Voiced speech and unvoiced speech represent two ends of a range of voicing classification or degree (sometimes referred to as "voicedness") that characterizes relative proportions of periodic and turbulent airflow, as well as whether voicing is trending from unvoiced to voiced ("onset") or voiced to unvoiced ("offset"). As with GCI and F0, automatic analytical determination of voicing state from a speech signal, remains challenging, despite the utility of such determinations in practical applications. Unvoiced speech is sometimes considered as "silence," though not necessarily in a sense of a complete absence of airflow.

While automatic determination of F0, GCI, and voicing state from a speech signal can be useful, and in some instances necessary, for practical applications involving speech synthesis, speech coding, and medical diagnostics, among others, reliable and accurate estimation of these characteristics of speech production have been historically difficult to obtain. Part of the reason may be that techniques that may be well-suited to estimate one of the characteristics may not apply as well to one or both of the others, or may not apply over a broad range of frequencies, for example. The need for accurate and reliable estimates, however, remains.

In accordance with example embodiments described herein, accurate and reliable estimates of F0, GCIs, and voicing state may be obtained by simultaneous determination of all three quantities from a speech signal. More particularly, a speech signal may be processed to determine candidate GCIs and candidate F0s. Candidate GCIs may be paired with candidate F0 in hypotheses of concurrency, which may also include further hypotheses of voicing state. The hypotheses may also include one or more quality scores that can connect the hypotheses to the observed data of the speech signal, and support determination of "cost" of each hypothesis. By applying dynamic programming to a set of hypotheses, a least-cost path connecting the "best" hypotheses may be determined in a form of optimization, from which accurate and reliable estimates of GCIs, F0, and voicing state may then be obtained.

Also in accordance with example embodiments, the procedures for processing a speech signal to determine candidate GCIs and F0s, constructing and scoring the hypotheses, applying dynamic programming, and deriving the estimates, along with other ancillary and/or supporting procedures, can be implemented in the form of machine-readable instructions (e.g., computer code) by one or more processors of a speech analysis system, or other type of processor-base system. The speech signal could be in the form of digitized samples at discrete sample times of an input sample stream, and the determined GCIs, F0s, and voicing state could be used in one or more applications, and/or stored in data file on machine-readable storage medium (e.g., magnetic, optical, or solid state disk, flash memory, etc.). As noted above, applications that used the determined GCIs, F0s, and/or voicing state could include speech synthesis, voice encoding, and medical diagnostics.

2. Example Method

In example embodiments, a speech analysis system may include one or more processors, one or more forms of memory, one or more input devices/interfaces, one or more output devices/interfaces, and machine-readable instructions that when executed by the one or more processors cause the speech synthesis system to carry out the various functions and tasks described herein. In particular, the functions and tasks may form a basis for simultaneous estimation of glottal closure instant (GCI), fundamental frequency (F0), and voicing state of a speech signal. An example of method for generating such an estimate is described in the current section.

FIG. 1 is a flowchart illustrating an example method in accordance with example embodiments. At step 102, a system having one or more processors receives a speech signal including a first temporal sequence of speech-signal samples. Each speech-signal sample is at a respective sample time in the first temporal sequence. More specifically, each speech-signal sample may be a digitized measurement of a speech waveform. As such, each may be referred to as a "digital sample." By way of example, the source of the speech waveform could be a real-time waveform, such as produced by a microphone (or other audio input device) in response to a real-time utterance spoken by a user. Alternatively or additionally, the source could be a prerecorded waveform supplied as input to the system.

At step 104, the system processes the received speech signal to determine a second temporal sequence of candidate glottal closure instants (GCIs). Each candidate GCI corresponds to (e.g., marks or is identified with) a respective sample time in the first temporal sequence. Processing of the received speech signal may also determine a respective set of candidate fundamental frequencies (F0s) for each candidate GCI of the second temporal sequence. In addition, processing of the received speech signal may also determine a metric of voicing degree of the speech signal at a sample time corresponding to each respective candidate GCI. That is, for each candidate GCI, a respective set of candidate F0s and a metric of voicing degree are also determined from the speech signal.

At step 106, for each candidate GCI of the second temporal sequence, a respective objective function is determined for each respective candidate F0 of the respective set F0 candidates. Each objective function includes a respective hypothesis of a concurrence of all three of the respective candidate GCI, the respective candidate F0, and a voicing state of the speech signal, and each respective hypothesis includes a GCI-period score for a correspondence between the respective candidate F0 and a subsequent candidate GCI of the second temporal sequence. More particularly, each hypothesis may be considered as a postulation that a given candidate GCI marks an actual (true) GCI, that a given candidate F0 at the time marked by the GCI is an actual F0, and that the speech signal is described by a particular voicing state at the time marked by the GCI. Because the period between successive GCIs can be related to F0, one measure of the hypothesis can be based on how well a candidate F0 corresponds to the period between successive candidate GCIs. As described below, the GCI-period score is a way to quantify this correspondence.

At step 108, for each candidate GCI of the second temporal sequence, a cost is determined for each respective hypothesis. The cost for each hypothesis is based, at least in part, on both the GCI-period score and the metric of voicing degree.

At step 110, a sequence of hypotheses corresponding to a least-cost path through the candidate GCIs is determined. The sequence of hypotheses includes at most one hypothesis associated with each candidate GCI. That is, each candidate GCI of the second temporal sequence is represented at most just once in the sequence of hypotheses that corresponds to the least-cost path. Thus, even though a given candidate GCI may be associated with more than one hypothesis by virtue of multiple candidate F0s associated with the given candidate GCI, only one of the possibly multiple hypotheses associated with the given candidate GCI may be included in the sequence of hypotheses that corresponds to the least-cost path.

Finally, at step 112, the procedure backtracks through the least-cost path to determine a cost-optimal set of GCIs of the received speech signal. Part of this determination may also include determination of at least one cost-optimal F0 for at least one GCI of the cost-optimal set. More particularly, a set of cost-optimal F0s may also be determined that corresponds in whole or in part to the cost-optimal set of GCIs.

In accordance with example embodiments, processing the received speech signal to determine the second temporal sequence of GCIs (step 104) could correspond to determining linear predictive code (LPC) residuals of the speech signal at each respective sample time in the first temporal sequence, normalizing the LPC residuals (or a function of the LPC residuals as described below), and then identifying sub-sequences of consecutive values of the normalized LPC residuals that both meet a set of pulse-shape criteria and have at least one peak magnitude normalized LPC residual value that exceeds a LPC residual threshold. A respective GCI-quality score could be determined for each identified sub-sequence based on the respective peak magnitude normalized LPC residual value and on a respective pulse shape relative to the pulse-shape criteria. The sample time of the peak magnitude normalized LPC residual of each identified sub-sequence could be used to mark an associated candidate GCI, and the respective GCI-quality score of each identified sub-sequence could be associated with the corresponding candidate GCI. By way of example, the normalized LPC residuals could be determined by normalizing the LPC residuals by a temporally local root-mean-square (RMS) measure of at least a subset of the LPC residuals. For instance, each given LPC residual (i.e., at a given sample time) could be normalized by an RMS measure over a Hann window of samples centered on the given LPC residual. Other local RMS measures could be determined as well.

In further accordance with example embodiments, the LPC residuals could be subject to a form of conditioning prior to the normalization described above. More particularly, the LPC residuals could first be polarity-corrected, whereby a mean value of the LPC residuals is subtracted from the LPC residuals to yield mean-shifted LPC residuals, and then a separate RMS calculated for positive and negative values. If the negative values yield the highest RMS, this may indicate a likely presence of GCIs, since they may be expected to be characterized by negative LPC residuals. In this case, the LPC residual values can be left unchanged. If, instead, the positive RMS is greater than the negative RMS, this may indicate that the positive components of the LPC residuals are more peaky. In this case the LPC residuals may be sign-inverted (polarity reversed). The normalized LPC residuals may then be determined from the polarity-corrected LPC residuals. More generally, the normalized LPC residuals may be considered as being determined from a function of the LPC residuals. As just described, the function could be polarity correction, although other functions, including an identity function or a null function (e.g., a function that leaves the LPC residuals unchanged) may be applied as well.

In further accordance with example embodiments, processing the received speech signal to determine the respective set of candidate F0s of the speech signal (also at step 104) could correspond to determining a linear combination of the first temporal sequence and of the LPC residuals, then determining a normalized cross-correlation function (NCCF) of the linear combination. A separate NCCF computation could be centered at the respective sample time of each respective candidate GCI and carried out within a time window corresponding to a range of F0 values from a minimum F0 value to a maximum F0 value. For each such computation, peak NCCF values, or local maxima, that exceed a NCCF threshold value could be identified, and a lag time of each maximum could be associated with one of the candidate F0s for the respective candidate GCI. More specifically, the inverse of the time difference between the respective candidate GCI and the lag time associated with any given one of the NCCF maxima could be considered the candidate F0 associated with the given NCCF peak.

In accordance with example embodiments, processing the received speech signal to determine the metric of voicing degree of the speech signal (also at step 104) could correspond to subdividing the first temporal sequence into sequential frames of speech-sample signals, each of the sequential frames having a respective frame time, and then determining a band-limited RMS value of speech-sample signals within each of the sequential frames. A respective voicing indicator value, a respective voicing onset indicator value, and a respective voicing offset indicator value could each be determined based on the determined band-limited RMS value of each of the sequential frames. The metric of voicing degree could be taken to correspond to the three determined indicators. Since each sequential frame and its band-limited RMS value may correspond to multiple consecutive sample times, the metric of voicing degree associated with a given candidate GCI could be identified as a frame time closest to the respective sample time corresponding to the candidate GCI.

In accordance with example embodiments, determining the objective function for each respective candidate F0 of the respective set (at step 106) could correspond to constructing a hypothesis of a concurrence of the respective candidate GCI and the respective candidate F0, for each respective candidate F0 of the respective set. A GCI-period score could be determined for each constructed hypothesis. Each hypothesis could be further extended by a postulation that the speech signal is in a voiced state at the respective sample time of the candidate GCI. In addition, a postulation that the speech signal is instead in an unvoiced state at the sample time of the candidate GCI could be made for at least one of the hypotheses.

In further accordance with example embodiments, determining the GCI-period score could correspond to determining a respective time period based on an inverse of the respective candidate F0, and determining a predicted GCI corresponding to the respective candidate F0 by adding the respective time period to the respective sample time corresponding to the respective candidate GCI. That is, the next predicted GCI following the respective candidate GCI could be estimated as one F0 time period after the candidate GCI (where the F0 time period is just the inverse of F0). Then the GCI-period score could be determined based on a temporal proximity of the predicted GCI to the subsequent candidate GCI of the second temporal sequence. Thus, the GCI-period score could be interpreted as a temporal proximity score.

In accordance with example embodiments, determining the cost for each respective hypothesis (at step 108) could be achieved by determining a respective NCCF-peak score for the respective candidate F0 based on the peak NCCF value associated with the respective candidate F0, and then merging the GCI-period score, the metric of voicing degree of the speech signal at the respective sample time corresponding to the respective candidate GCI, the respective GCI-quality score, and the respective NCCF-peak score. If the respective candidate GCI is not the first candidate GCI of the second temporal sequence, a temporally prior candidate GCI could be determined based on a prior candidate F0 associated with the temporally prior candidate GCI. Similarly, if the respective candidate GCI is not the last candidate GCI of the second temporal sequence, a temporally subsequent candidate GCI could be determined based on the respective candidate F0.

By way of example, the determination of the sequence of hypotheses corresponding to the least-cost path through the candidate GCIs (at step 110) could be made by determining a directed graph of all connections between candidate GCIs that traverse each candidate GCI at most once. More particularly, each connection could correspond to a respective period between a temporally-earlier candidate GCI and a temporally-later candidate GCI, where the respective period corresponds to an inverse of the candidate F0 of a given one of the hypotheses of the temporally-earlier candidate GCI. Thus, for a given candidate GCI, the inverse of each of possibly multiple F0s when added to the sample time of the given candidate GCI would yield a possible connection to a subsequent candidate GCI. Each respective path through the candidate GCIs would include one such connection between any particular pair of a temporally-earlier candidate GCI and a temporally-later candidate GCI, and the graphic sum of all such connections would correspond to the respective path. For each such path, a cumulative cost could be determined, and the path with the smallest cumulative cost could be selected as the least-cost path.

A determination that the best hypothesis for a given candidate GCI corresponds to an unvoiced state could indicate that the candidate GCI is not a true GCI. In this case, the connection between a prior voiced GCI and the given candidate GCI could represent a transition from a voiced to an unvoiced state. Similarly, the connection between the given candidate GCI and the next voice GCI could represent a transition from an unvoiced to a voiced state.

By way of example, determining the sequence of hypotheses corresponding to the least-cost path through the candidate GCIs in a manner as described above could be achieved by applying dynamic programming to the directed graph of connections between the sequence of hypotheses corresponding to the least-cost path through the candidate GCIs.

In accordance with example embodiments, backtracking through the least-cost path to determine the cost-optimal set of GCIs of the received speech signal could correspond to identifying all candidate GCIs traversed by the selected determined path.

In further accordance with example embodiments, the cost-optimal set of GCIs, possibly as well as one or more corresponding cost-optimal F0s and voicing state, could be used to facilitate and/or enhance concatenation-based speech synthesis, a speech synthesis technique based on concatenation of stored speech units. By way of example, speech units used in concatenation could be phonemes. As will be appreciated, phonemes are speech segments that generally correspond to the smallest units of speech that are distinguishable from each other. There are, for example, approximately 40-50 phonemes in spoken English. Spoken words (or other segments of speech) can be constructed from appropriate sequences of subsets of phonemes. In a concatenative speech synthesis system, phonemes can be stored as small segments of audio data (e.g., in digitized form), each with an identifying phoneme label, and other ancillary information, such as context, time duration, etc. During synthesis, a sequence of phonemes may be determined that corresponds to a speech utterance being synthesized. By including GCIs, F0s, and voicing state associated with the stored phonemes, concatenation of phonemes (or other speech units) determined during synthesis can be achieved accurately. More particularly, GCIs can be used to determine temporal connection points between successive phonemes, thereby making the transition between concatenated phonemes sound like naturally produced speech. In addition, using F0 and voicing state may facilitate more accurate determination of speech units to include in the concatenation.

In order to incorporate GCIs, F0s, and voicing state with stored speech units, the received speech signal (e.g., at step 102) could be processed into phonetic units, such as phonemes. For example, the received speech signal could be processed using a speech recognition system (or an implementation of a speech recognition technique). Each of the phonetic units could include a sub-sequence of the first temporal sequence of speech-signal samples, together with an identifying label (e.g., a phoneme label). The sample times of each phonetic speech unit could then be marked with one or more GCIs from the cost-optimal set, and each marked phonetic speech unit could be stored in a speech-synthesis database for later use in concatenation-based synthesis. Each stored speech unit could also include one or more cost-optimal F0s corresponding to the GCIs, as well as voicing state. It will be appreciated that later use of the marked phonetic speech units could include using them to concatenate (e.g., synthesize) utterances and/or phrases other than the received speech signal from which the units were derived.

In still further accordance with example embodiments, the cost-optimal set of GCIs, possibly as well as one or more corresponding cost-optimal F0s and voicing state, could be used to facilitate and/or enhance narrow-band speech encoding. More specifically, the received speech signal could be processed to derive parameters for driving a narrow-band speech encoder (e.g. vocoder). The derived parameters and at least one GCI of the cost-optimal set to the narrow-band speech encoder could then be provided to the speech encoder to encode the received speech signal.

A further application of the cost-optimal set of GCIs, F0s and voicing state could be in medical diagnostics of speech production. More particularly, medical-diagnostic data corresponding to measurements of glottal function of a source of the speech signal during physiological production of the speech signal could be obtained in coordination with determination of the cost-optimal set of GCIs, F0s and voicing state of the speech signal. Comparison of the measurements of glottal function with one or more GCIs could then aid and/or enhance medical diagnosis and/or study based on the measurements.

It will be appreciated that the steps shown in FIG. 1 are meant to illustrate a method in accordance with example embodiments. As such, various steps could be altered or modified, the ordering of certain steps could be changed, and additional steps could be added, while still achieving the overall desired operation.

3. Example System and Device Architecture

Methods in accordance with an example embodiment, such as the on described above, devices could be implemented using so-called "thin clients" and "cloud-based" server devices, as well as other types of client and server devices. Under various aspects of this paradigm, client devices, such as mobile phones and tablet computers, may offload some processing and storage responsibilities to remote server devices. At least some of the time, these client services are able to communicate, via a network such as the Internet, with the server devices. As a result, applications that operate on the client devices may also have a persistent, server-based component. Nonetheless, it should be noted that at least some of the methods, processes, and techniques disclosed herein may be able to operate entirely on a client device or a server device.

This section describes general system and device architectures for such client devices and server devices. However, the methods, devices, and systems presented in the subsequent sections may operate under different paradigms as well. Thus, the embodiments of this section are merely examples of how these methods, devices, and systems can be enabled.

a. Example System

Figure 2:
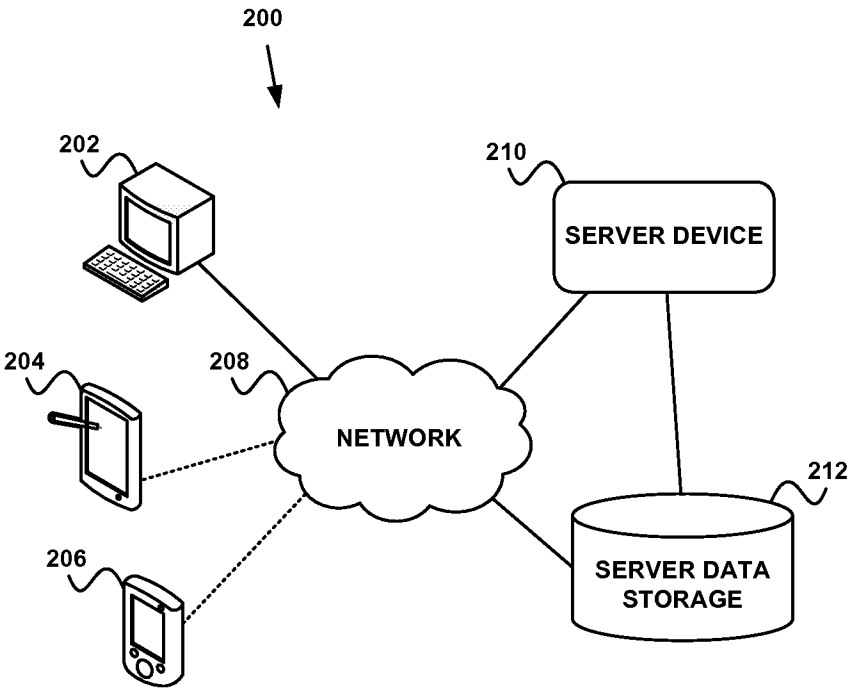
FIG. 2 is a block diagram of an example network and computing architecture, in accordance with an example embodiment.

FIG. 2 is a simplified block diagram of a communication system 200, in which various embodiments described herein can be employed. Communication system 200 includes client devices 202, 204, and 206, which represent a desktop personal computer (PC), a tablet computer, and a mobile phone, respectively. Client devices could also include wearable computing devices, such as head-mounted displays and/or augmented reality displays, for example. Each of these client devices may be able to communicate with other devices (including with each other) via a network 208 through the use of wireline connections (designated by solid lines) and/or wireless connections (designated by dashed lines).

Network 208 may be, for example, the Internet, or some other form of public or private Internet Protocol (IP) network. Thus, client devices 202, 204, and 206 may communicate using packet-switching technologies. Nonetheless, network 208 may also incorporate at least some circuit-switching technologies, and client devices 202, 204, and 206 may communicate via circuit switching alternatively or in addition to packet switching.

A server device 210 may also communicate via network 208. In particular, server device 210 may communicate with client devices 202, 204, and 206 according to one or more network protocols and/or application-level protocols to facilitate the use of network-based or cloud-based computing on these client devices. Server device 210 may include integrated data storage (e.g., memory, disk drives, etc.) and may also be able to access a separate server data storage 212. Communication between server device 210 and server data storage 212 may be direct, via network 208, or both direct and via network 208 as illustrated in FIG. 2. Server data storage 212 may store application data that is used to facilitate the operations of applications performed by client devices 202, 204, and 206 and server device 210.

Although only three client devices, one server device, and one server data storage are shown in FIG. 2, communication system 200 may include any number of each of these components. For instance, communication system 200 may comprise millions of client devices, thousands of server devices and/or thousands of server data storages. Furthermore, client devices may take on forms other than those in FIG. 2.

b. Example Server Device and Server System

Figure 3A:
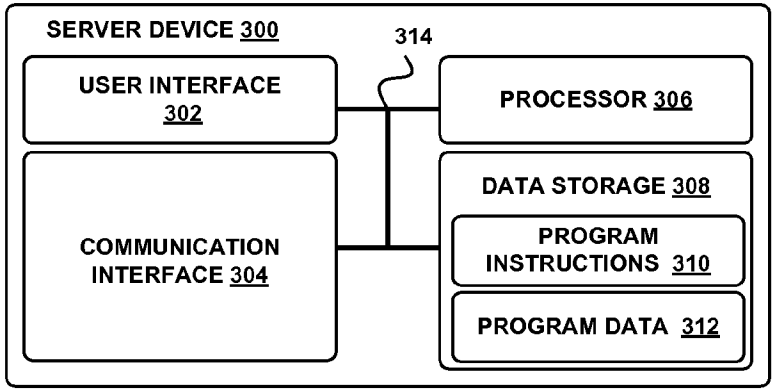
FIG. 3A is a block diagram of a server device, in accordance with an example embodiment.

FIG. 3A is a block diagram of a server device in accordance with an example embodiment. In particular, server device 300 shown in FIG. 3A can be configured to perform one or more functions of server device 210 and/or server data storage 212. Server device 300 may include a user interface 302, a communication interface 304, processor 306, and data storage 308, all of which may be linked together via a system bus, network, or other connection mechanism 314.

User interface 302 may comprise user input devices such as a keyboard, a keypad, a touch screen, a computer mouse, a track ball, a joystick, and/or other similar devices, now known or later developed. User interface 302 may also comprise user display devices, such as one or more cathode ray tubes (CRT), liquid crystal displays (LCD), light emitting diodes (LEDs), displays using digital light processing (DLP) technology, printers, light bulbs, and/or other similar devices, now known or later developed. Additionally, user interface 302 may be configured to generate audible output(s), via a speaker, speaker jack, audio output port, audio output device, earphones, and/or other similar devices, now known or later developed. In some embodiments, user interface 302 may include software, circuitry, or another form of logic that can transmit data to and/or receive data from external user input/output devices.

Communication interface 304 may include one or more wireless interfaces and/or wireline interfaces that are configurable to communicate via a network, such as network 208 shown in FIG. 2. The wireless interfaces, if present, may include one or more wireless transceivers, such as a BLUETOOTH® transceiver, a Wifi transceiver perhaps operating in accordance with an IEEE 802.11 standard (e.g., 802.11b, 802.11g, 802.11n), a WiMAX transceiver perhaps operating in accordance with an IEEE 802.16 standard, a Long-Term Evolution (LTE) transceiver perhaps operating in accordance with a 3rd Generation Partnership Project (3GPP) standard, and/or other types of wireless transceivers configurable to communicate via local-area or wide-area wireless networks. The wireline interfaces, if present, may include one or more wireline transceivers, such as an Ethernet transceiver, a Universal Serial Bus (USB) transceiver, or similar transceiver configurable to communicate via a twisted pair wire, a coaxial cable, a fiber-optic link or other physical connection to a wireline device or network.

In some embodiments, communication interface 304 may be configured to provide reliable, secured, and/or authenticated communications. For each communication described herein, information for ensuring reliable communications (e.g., guaranteed message delivery) can be provided, perhaps as part of a message header and/or footer (e.g., packet/message sequencing information, encapsulation header(s) and/or footer(s), size/time information, and transmission verification information such as cyclic redundancy check (CRC) and/or parity check values). Communications can be made secure (e.g., be encoded or encrypted) and/or decrypted/decoded using one or more cryptographic protocols and/or algorithms, such as, but not limited to, the data encryption standard (DES), the advanced encryption standard (AES), the Rivest, Shamir, and Adleman (RSA) algorithm, the Diffie-Hellman algorithm, and/or the Digital Signature Algorithm (DSA). Other cryptographic protocols and/or algorithms may be used instead of or in addition to those listed herein to secure (and then decrypt/decode) communications.

Processor 306 may include one or more general purpose processors (e.g., microprocessors) and/or one or more special purpose processors (e.g., digital signal processors (DSPs), graphical processing units (GPUs), floating point processing units (FPUs), network processors, or application specific integrated circuits (ASICs)). Processor 306 may be configured to execute computer-readable program instructions 310 that are contained in data storage 308, and/or other instructions, to carry out various functions described herein.

Data storage 308 may include one or more non-transitory computer-readable storage media that can be read or accessed by processor 306. The one or more computer-readable storage media may include volatile and/or non-volatile storage components, such as optical, magnetic, organic or other memory or disc storage, which can be integrated in whole or in part with processor 306. In some embodiments, data storage 308 may be implemented using a single physical device (e.g., one optical, magnetic, organic or other memory or disc storage unit), while in other embodiments, data storage 308 may be implemented using two or more physical devices.

Data storage 308 may also include program data 312 that can be used by processor 306 to carry out functions described herein. In some embodiments, data storage 308 may include, or have access to, additional data storage components or devices (e.g., cluster data storages described below).

Referring again briefly to FIG. 2, server device 210 and server data storage device 212 may store applications and application data at one or more locales accessible via network 208. These locales may be data centers containing numerous servers and storage devices. The exact physical location, connectivity, and configuration of server device 210 and server data storage device 212 may be unknown and/or unimportant to client devices. Accordingly, server device 210 and server data storage device 212 may be referred to as "cloud-based" devices that are housed at various remote locations. One possible advantage of such "cloud-based" computing is to offload processing and data storage from client devices, thereby simplifying the design and requirements of these client devices.

In some embodiments, server device 210 and server data storage device 212 may be a single computing device residing in a single data center. In other embodiments, server device 210 and server data storage device 212 may include multiple computing devices in a data center, or even multiple computing devices in multiple data centers, where the data centers are located in diverse geographic locations. For example, FIG. 2 depicts each of server device 210 and server data storage device 212 potentially residing in a different physical location.

Figure 3B:
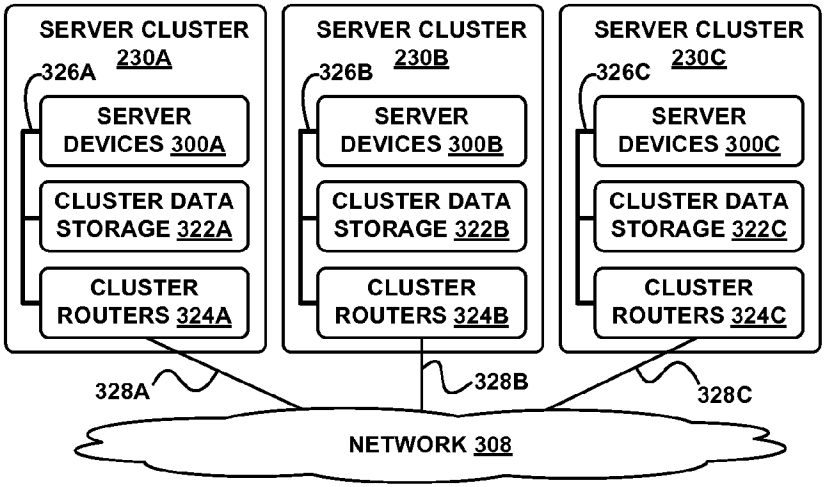
FIG. 3B depicts a cloud-based server system, in accordance with an example embodiment.

FIG. 3B depicts an example of a cloud-based server cluster. In FIG. 3B, functions of server device 210 and server data storage device 212 may be distributed among three server clusters 320A, 320B, and 320C. Server cluster 320A may include one or more server devices 300A, cluster data storage 322A, and cluster routers 324A connected by a local cluster network 326A. Similarly, server cluster 320B may include one or more server devices 300B, cluster data storage 322B, and cluster routers 324B connected by a local cluster network 326B. Likewise, server cluster 320C may include one or more server devices 300C, cluster data storage 322C, and cluster routers 324C connected by a local cluster network 326C. Server clusters 320A, 320B, and 320C may communicate with network 308 via communication links 328A, 328B, and 328C, respectively.

In some embodiments, each of the server clusters 320A, 320B, and 320C may have an equal number of server devices, an equal number of cluster data storages, and an equal number of cluster routers. In other embodiments, however, some or all of the server clusters 320A, 320B, and 320C may have different numbers of server devices, different numbers of cluster data storages, and/or different numbers of cluster routers. The number of server devices, cluster data storages, and cluster routers in each server cluster may depend on the computing task(s) and/or applications assigned to each server cluster.

In the server cluster 320A, for example, server devices 300A can be configured to perform various computing tasks of a server, such as server device 210. In one embodiment, these computing tasks can be distributed among one or more of server devices 300A. Server devices 300B and 300C in server clusters 320B and 320C may be configured the same or similarly to server devices 300A in server cluster 320A. On the other hand, in some embodiments, server devices 300A, 300B, and 300C each may be configured to perform different functions. For example, server devices 300A may be configured to perform one or more functions of server device 210, and server devices 300B and server device 300C may be configured to perform functions of one or more other server devices. Similarly, the functions of server data storage device 212 can be dedicated to a single server cluster, or spread across multiple server clusters.

Cluster data storages 322A, 322B, and 322C of the server clusters 320A, 320B, and 320C, respectively, may be data storage arrays that include disk array controllers configured to manage read and write access to groups of hard disk drives. The disk array controllers, alone or in conjunction with their respective server devices, may also be configured to manage backup or redundant copies of the data stored in cluster data storages to protect against disk drive failures or other types of failures that prevent one or more server devices from accessing one or more cluster data storages.

Similar to the manner in which the functions of server device 210 and server data storage device 212 can be distributed across server clusters 320A, 320B, and 320C, various active portions and/or backup/redundant portions of these components can be distributed across cluster data storages 322A, 322B, and 322C. For example, some cluster data storages 322A, 322B, and 322C may be configured to store backup versions of data stored in other cluster data storages 322A, 322B, and 322C.

Cluster routers 324A, 324B, and 324C in server clusters 320A, 320B, and 320C, respectively, may include networking equipment configured to provide internal and external communications for the server clusters. For example, cluster routers 324A in server cluster 320A may include one or more packet-switching and/or routing devices configured to provide (i) network communications between server devices 300A and cluster data storage 322A via cluster network 326A, and/or (ii) network communications between the server cluster 320A and other devices via communication link 328A to network 308. Cluster routers 324B and 324C may include network equipment similar to cluster routers 324A, and cluster routers 324B and 324C may perform networking functions for server clusters 320B and 320C that cluster routers 324A perform for server cluster 320A.

Additionally, the configuration of cluster routers 324A, 324B, and 324C can be based at least in part on the data communication requirements of the server devices and cluster storage arrays, the data communications capabilities of the network equipment in the cluster routers 324A, 324B, and 324C, the latency and throughput of the local cluster networks 326A, 326B, 326C, the latency, throughput, and cost of the wide area network connections 328A, 328B, and 328C, and/or other factors that may contribute to the cost, speed, fault-tolerance, resiliency, efficiency and/or other design goals of the system architecture.

c. Example Client Device

Figure 4:
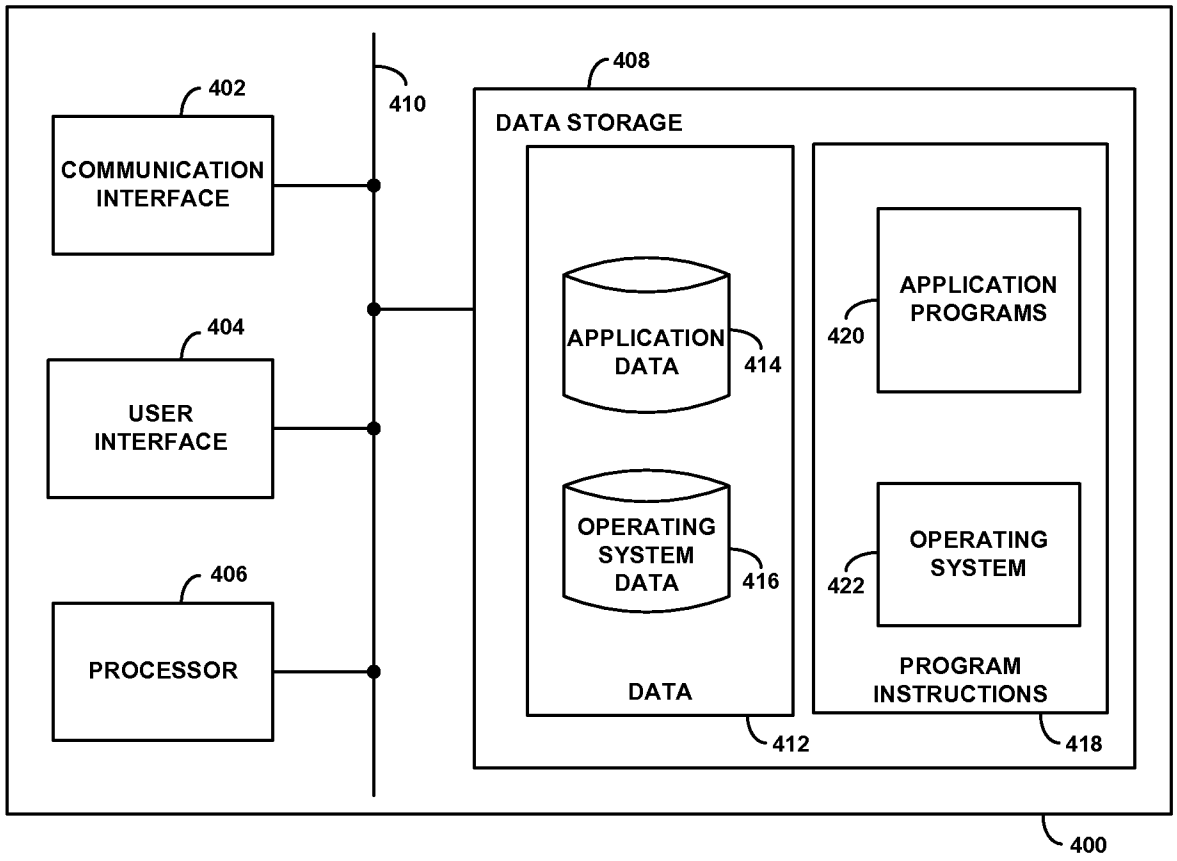
FIG. 4 depicts a block diagram of a client device, in accordance with an example embodiment.

FIG. 4 is a simplified block diagram showing some of the components of an example client device 400. By way of example and without limitation, client device 400 may be or include a "plain old telephone system" (POTS) telephone, a cellular mobile telephone, a still camera, a video camera, a fax machine, an answering machine, a computer (such as a desktop, notebook, or tablet computer), a personal digital assistant (PDA), a wearable computing device, a home automation component, a digital video recorder (DVR), a digital TV, a remote control, or some other type of device equipped with one or more wireless or wired communication interfaces.

As shown in FIG. 4, client device 400 may include a communication interface 402, a user interface 404, a processor 406, and data storage 408, all of which may be communicatively linked together by a system bus, network, or other connection mechanism 410.

Communication interface 402 functions to allow client device 400 to communicate, using analog or digital modulation, with other devices, access networks, and/or transport networks. Thus, communication interface 402 may facilitate circuit-switched and/or packet-switched communication, such as POTS communication and/or IP or other packetized communication. For instance, communication interface 402 may include a chipset and antenna arranged for wireless communication with a radio access network or an access point. Also, communication interface 402 may take the form of a wireline interface, such as an Ethernet, Token Ring, or USB port. Communication interface 402 may also take the form of a wireless interface, such as a Wifi, BLUETOOTH®, global positioning system (GPS), or wide-area wireless interface (e.g., WiMAX or LTE). However, other forms of physical layer interfaces and other types of standard or proprietary communication protocols may be used over communication interface 402. Furthermore, communication interface 402 may comprise multiple physical communication interfaces (e.g., a Wifi interface, a BLUETOOTH® interface, and a wide-area wireless interface).

User interface 404 may function to allow client device 400 to interact with a human or non-human user, such as to receive input from a user and to provide output to the user. Thus, user interface 404 may include input components such as a keypad, keyboard, touch-sensitive or presence-sensitive panel, computer mouse, trackball, joystick, microphone, still camera and/or video camera. User interface 404 may also include one or more output components such as a display screen (which, for example, may be combined with a touch-sensitive panel), CRT, LCD, LED, a display using DLP technology, printer, light bulb, and/or other similar devices, now known or later developed. User interface 404 may also be configured to generate audible output(s), via a speaker, speaker jack, audio output port, audio output device, earphones, and/or other similar devices, now known or later developed. In some embodiments, user interface 404 may include software, circuitry, or another form of logic that can transmit data to and/or receive data from external user input/output devices. Additionally or alternatively, client device 400 may support remote access from another device, via communication interface 402 or via another physical interface (not shown).

Processor 406 may comprise one or more general purpose processors (e.g., microprocessors) and/or one or more special purpose processors (e.g., DSPs, GPUs, FPUs, network processors, or ASICs). Data storage 408 may include one or more volatile and/or non-volatile storage components, such as magnetic, optical, flash, or organic storage, and may be integrated in whole or in part with processor 406. Data storage 408 may include removable and/or non-removable components.

In general, processor 406 may be capable of executing program instructions 418 (e.g., compiled or non-compiled program logic and/or machine code) stored in data storage 408 to carry out the various functions described herein. Therefore, data storage 408 may include a non-transitory computer-readable medium, having stored thereon program instructions that, upon execution by client device 400, cause client device 400 to carry out any of the methods, processes, or functions disclosed in this specification and/or the accompanying drawings. The execution of program instructions 418 by processor 406 may result in processor 406 using data 412.

By way of example, program instructions 418 may include an operating system 422 (e.g., an operating system kernel, device driver(s), and/or other modules) and one or more application programs 420 (e.g., address book, email, web browsing, social networking, and/or gaming applications) installed on client device 400. Similarly, data 412 may include operating system data 416 and application data 414. Operating system data 416 may be accessible primarily to operating system 422, and application data 414 may be accessible primarily to one or more of application programs 420. Application data 414 may be arranged in a file system that is visible to or hidden from a user of client device 400.

Application programs 420 may communicate with operating system 412 through one or more application programming interfaces (APIs). These APIs may facilitate, for instance, application programs 420 reading and/or writing application data 414, transmitting or receiving information via communication interface 402, receiving or displaying information on user interface 404, and so on.

In some vernaculars, application programs 420 may be referred to as "apps" for short. Additionally, application programs 420 may be downloadable to client device 400 through one or more online application stores or application markets. However, application programs can also be installed on client device 400 in other ways, such as via a web browser or through a physical interface (e.g., a USB port) on client device 400.

4. Example Operation

Figure 5:
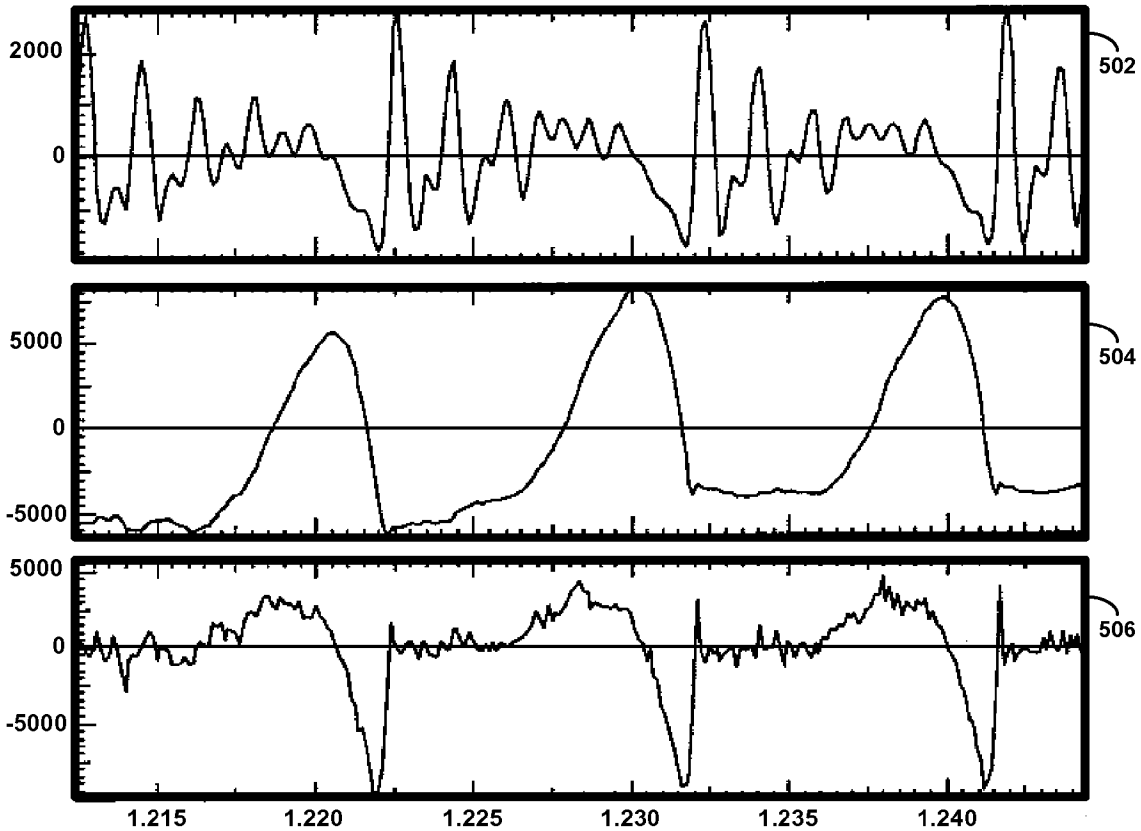
FIG. 5 depicts an example speech signal, an estimate of glottal flow corresponding to the example speech signal, and a time derivative of the estimated glottal flow, in accordance with an example embodiment.

The physiology of speech production involves a dynamic mechanical process of airflow from the lungs, through the vocal tract, and ultimately out of the mouth through the lips. In analytical terms, airflow through the glottis may be considered a glottal volume velocity, expressed as U(t), that serves as forcing function that determines the periodicity of voiced speech. Because the glottis regulates airflow, the time derivative of the glottal volume velocity, dU/dt=U'(t), can be indicative of glottal closures. FIG. 5 illustrates a relation between a speech signal 502, the corresponding glottal volume velocity U(t) 504, and the time derivative U'(t) 506. A time duration of approximately 0.025 seconds applies to all three plots in FIG. 5. By way of example, the speech signal corresponds to production of the phoneme /a/.

During the speech production, the glottal volume velocity U(t) 504 shows periodic amplitude variations that rise gradually, corresponding to the opening of the glottis, and that drop sharply, corresponding the rapid closing of the glottis. The derivative of glottal volume velocity U'(t) 506 shows relatively gradual positive rises corresponding to the gradual increases in glottal volume velocity U(t) 504, and sharp negative peaks corresponding to glottal closures. This trend and pulse shape in the derivative of glottal volume velocity suggests that times corresponding to the negative peaks can be associated with GCIs of the speech signal.

In accordance with example embodiments, a speech signal may be obtained in the form of a stream or sequence of N speech-signal samples s(i) at discrete sample times $t_i$, i=0, . . . N−1. The digital samples could be obtained by digitally sampling an analog speech signal at the discrete sample times, for example using a digital signal processor. The speech signal could correspond to a spoken utterance, such as a phoneme, a word, a phrase, a sentence, or another segment of speech. The time between successive samples is the sampling period, and its inverse is the sample frequency or sampling rate. In terms of $t_i$, the sampling period can be expressed as $\Delta t=t_i-t_{i-1}$, and the sampling rate expressed as $1/\Delta t$. Typical sampling rates for speech signals may range from 8 kHz (kilo samples per second) to 22.05 kHz, although other sampling rates could be used.

Figure 6:
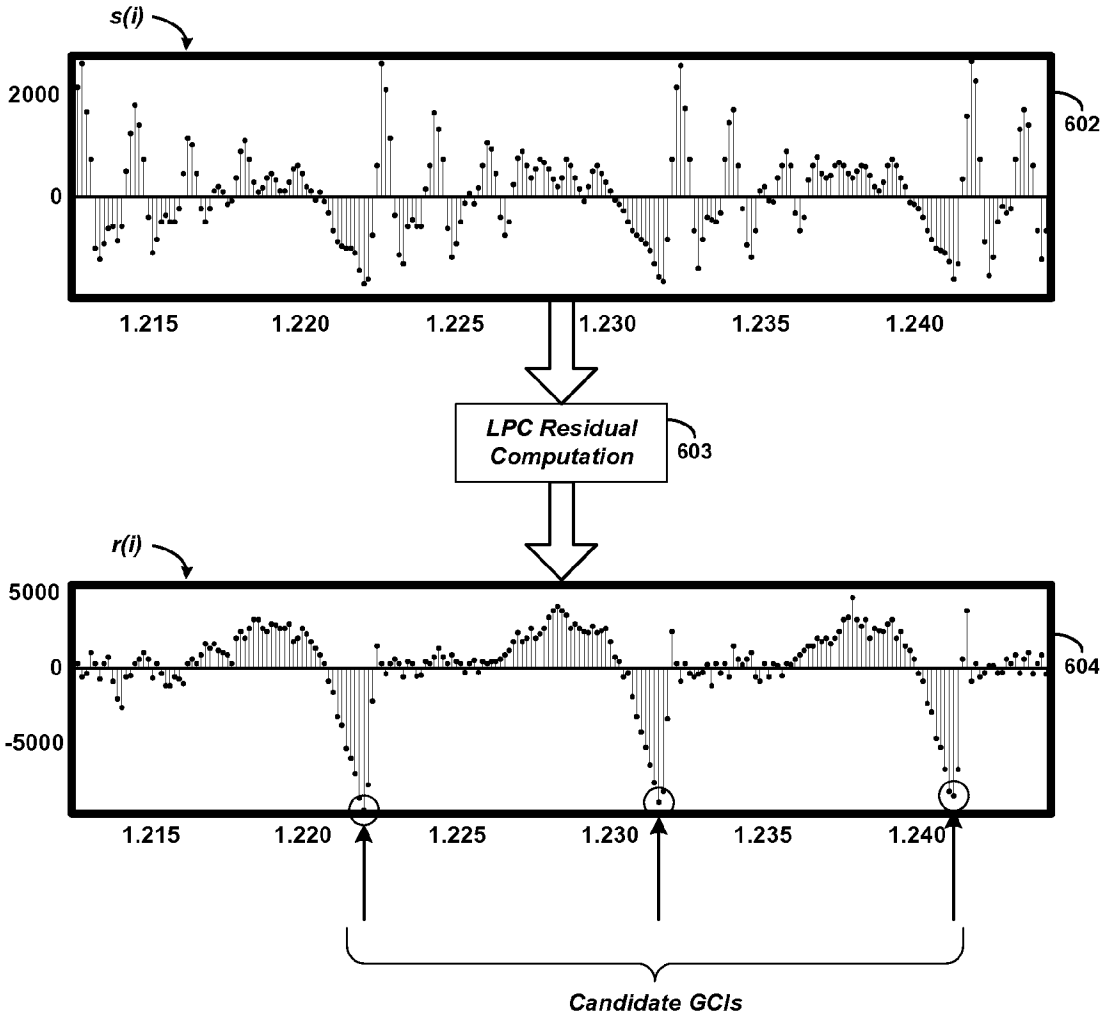
FIG. 6 illustrates the example speech signal as measured in speech-signal samples, and linear predictive code residuals of the speech signal, as measured at sample times, in accordance with an example embodiment.

FIG. 6 illustrates a digital speech signal 602. Each sample is represented by a vertical line with dot marking a positive or negative amplitude relative to a horizontal line at zero amplitude. The digital speech signal could correspond to a digitally sampled version of speech signal 502 in FIG. 5, for example. For purposes of depicting individual samples in FIG. 6, the sampling rate shown is evidently much smaller than 8 kHz. This should not be viewed as a limitation with respect to the example embodiments described herein.

For a digital speech signal s(i), such as the digital speech signal 602, the derivative of the volume velocity may be approximated by computing linear predictive code (LPC) residuals of the sequence of speech-signal samples. Computation of LPC residuals of a digital speech signal s(i) may be carried out according well-known LPC residual analytical techniques, as implemented in machine-language instructions (e.g., computer code) executable by one or more processors, for example. For the illustration in FIG. 6, LPC residual computation 603 may be applied to the digital speech signal 602 to generate LPC residual samples 604. The LPC residual samples 604, expressed as r(i) at discrete sample times $t_i$, i=0, . . . N−1, could correspond to a discrete digital approximation of the time derivative U'(t) 506 in FIG. 5, for example. Note that the s(i) and r(i) are phase-aligned and have the same sampling times $t_i$.

The significant negative peaks of the LPC residual samples 604 may correspond to glottal closures, and the corresponding sample times of these negative peaks may thus correspond to glottal closure instants. Thus, LPC residuals of a digital speech signal may provide a basis for initial identification of GCIs in the digital speech signal. More particularly, analysis of LPC residuals can be used to identify negative peaks that may mark time instants in the digital speech signal that correspond to GCIs in the production of the original speech signal that is represented in the digital samples of the digital speech signal. As described below, determining that what appears to be a GCI in the LPC residuals actually or likely corresponds to a true GCI may involve further analysis of the data in accordance with principles and techniques of example embodiments herein. In this context, then, initial identification of GCIs from LPC residuals may be considered "candidate" GCIs. By way of example in FIG. 6, three candidate GCIs in the LPC residual samples 604 are circled and their times indicated by vertical arrows. It will be appreciated that longer speech signal (e.g., multiple phonemes, a word, a sentence, etc.) could show indications of more candidate GCIs, and that the illustrative description of just three is not limiting with respect to example embodiments discussed herein.

The fundamental frequency F0 of the produced speech is related to the spectral and temporal energy distribution of the speech, but generally not as a linear combination of frequency components. As noted earlier, the somewhat descriptive property referred to as "pitch" may be defined in terms of listener perception, and does not necessarily recommend a convenient or rigorous analytical approach to determining F0 from a digital speech signal. However, F0 may be related in the inverse to the period between GCIs, suggesting that F0 values and GCIs in a digital speech signal may be determined together through a form of optimization. More specifically, "candidate" F0s determined from a digital speech signal may be computationally linked with candidate GCIs from the signal within the framework of an optimization problem, whereby solving the optimization problem may yield optimal determinations of both the GCIs and F0s.

As a further element of the optimization problem, the voicing state of the produced speech may be introduced to help discriminate among optimization paths of the framework. Because the voicing state can be related to the relative proportions of periodic and turbulent airflow in speech production, it is possible to analytically connect voicing state to both candidate GCIs and F0s, and thereby provide an additional basis for their evaluation within the optimization context. For example, during unvoiced speech, evidence of periodicity between candidate GCIs might be expected to be lacking. Similarly, correlations between candidate GCIs and candidate F0s might also be weaker for unvoiced than for voiced speech.

In accordance with example embodiments, the optimization problem may be constructed analytically as a collection of hypotheses, each of which hypothesizes a concurrence of a candidate GCI, a candidate F0, and a voicing state, and which further includes a computational basis for determining an associated cost. The collection may be constructed to represent possible GCIs, F0s, and voicing states present in a digital voice signal, and each hypothesis can thus be considered as marking a particular sample time of the digital speech signal. As such, each hypothesis may have a "link" to a temporally prior and/or a temporally later hypothesis of the collection, whereby each of one or more sequences of links may represent a respective path through the collection of hypotheses. The cost of each hypothesis provides a quantitative evaluation of the hypothesized concurrence, and accounts for a quantitative evaluation of links to temporally prior and/or temporally later hypotheses. By applying dynamic programming to the collection of hypotheses, a least-cost path may be determined, from which an optimal set GCIs and F0s may be derived.

The analytical framework and techniques outlined above may be described operationally in terms of an algorithm that can be implemented as machine-language instructions (e.g., computer code) executable by one or more processors, for example. Such an algorithm for simultaneous estimation of GCI, F0, and voicing state of a speech signal in accordance with example embodiments is described below. The algorithm (and its implementation) assume that a digital speech signal s(i) at discrete sample times $t_i$, i=0, . . . N−1 is to be processed. The sampling rate could be in a range of $f_s$=8 kHz to 22.05 kHz, for example. By way of example, s(i) could correspond to a spoken utterance, such as a word, a phrase, or sentence, that has a duration of one or more seconds (e.g., 1-10 seconds). More generally, the algorithm may benefit when one or more portions of an utterance can provide context for other portions. This could correspond to utterances that may be expected to include tens of true GCIs, for example. However, the algorithm does not necessarily require this to be the case, and other forms of shorter utterances are possible as well, such as phonemes or triphones, for example.

The algorithm can be described as having six phases. In the first phase, the signal s(i) is obtained in a form described above. The signal could be obtained from real-time speech production, or from a prerecorded speech signal, for example.

The second phase corresponds to preliminary processing of the signal, which can included all-pass filtering of s(i) to correct possible phase distortion introduced, for example, during acquisition by a microphone or during recording. The second phase can additionally or alternatively include high-pass filtering of s(i) to remove possible low-frequency rumble and DC (direct current) distortion. Note that these filtering actions do not alter s(i) in a manner necessarily required by, or disruptive to, the subsequent phases of the algorithm. As such, they may be considered optional, their necessity and/or desirability being determined by the nature and quality of s(i) as received or obtained. Techniques for all-pass and high-pass filtering of digitized signal such as s(i) are generally known, and not discussed further herein.

During the third phase, the speech signal is processed to determine the candidate GCIs, candidate F0s, and metrics of the degree of voicing at times corresponding to the candidate GCIs. In the fourth phase, a lattice of hypotheses is created in preparation for solving an optimization problem for simultaneously optimizing GCI, F0, and voicing state. In the fifth phase, dynamic programming is used to solve the optimization problem by determining a least-cost path through the lattice. Finally, in the sixth phase, an optimal set of GCIs, as well as F0s and voicing state are determined by backtracking through the least-cost path. The third through sixth phases are discussed in further detail below.

As a first step in determining candidate GCIs (third phase of algorithm), LPC residuals are computed from s(i) according to known computational methods. Following from the example in FIG. 6 discussed above, the LPC residuals r(i) may be computed at discrete sample times t i=0, . . . N−1, phase aligned with s(i). The polarity of r(i) may then be adjusted to reflect the relative levels of positive and negative excursions present. More specifically, an overall mean can be subtracted from r(i), and a separate RMS computed for positive and negative values. If the RMS of the positive values exceeds that of the negative values, r(i) may be inverted in place to yield a polarity-corrected version of r(i).

The polarity-corrected r(i) for each t i=0, . . . N−1, may next be normalized by a "sliding" RMS value determined locally to each $t_i$. More specifically, an RMS value over a Hann window at each $t_i$ may be computed as a normalization factor at that $t_i$. The normalized version of r(i), referred to as nr(i), has a value at each t i=0, . . . N−1, and is also phase aligned with s(i). By way of example, a Hann window of 20 milliseconds (ms) may be appropriate, although other window sizes are possible as well. The normalized, polarity-corrected LPC residuals, nr(i), provide a basis for determining candidate GCI pulses, as described below.

In preparation for determining candidate F0s, a "mixture signal" is generated as a linear combination of the original (possibly filtered) signal s(i) and the unprocessed (not polarity-corrected) r(i). More specifically, the mixture signal is computed as $rs(i)=a\times s(i)+(1-a)\times r(i)$, where a is a multiplicative mixture coefficient, and r(i) corresponds to the LPC residuals prior to the polarity correction described above. By way of example, a value of a=0.3 may be used, although other values are possible as well. The mixture signal may be used as a basis for a search for candidate F0s, as described below.

Next, in order to determine a metric of degree of voicing at times corresponding to each candidate GCI, s(i) may be segmented in a sequence of M "feature frames," j=0, . . . , M−1. The feature frames may be arranged in an overlapping fashion, each having a duration $w_{ff}$ and an interval from on to the next of $w_b<f_s$. By way of example, $f_b$ could be 500 Hz and $w_{ff}$ could be 25 ms, although other values are possible as well. This would correspond to feature frames each overlapping by 23 ms, one to the next. Each feature frame could be identified with a frame time; for example frame times could be the times at the center of each feature frame. In the example above, these would correspond to times at 12.5 ms, 14.5 ms, 16.5 ms, and so on. Other frame-time definitions could be used as well.

For each feature frame, a band-limited RMS, $b_{RMS}(j)$, j=0, . . . , M−1, could be computed using a Hann window and band edges in a range of 100 Hz to 1000 Hz, for example. The Hann window could correspond to the duration of each feature frame $w_{ff}$. For the above example this would correspond to a width of 25 ms, although other values could be used. Empirically, $b_{RMS}(j)$ tends to be well correlated with the presence and amplitude of voicing in a speech signal, such as s(i).

A metric of degree of voicing can be determined for each j=0, . . . , M−1, where each metric includes three indicators related to voicing state, based on $b_{RMS}(j)$. A voicing indicator, $p_v(j)$, can be determined as a pseudo-probability corresponding to "voicedness" of the speech represented in the $j^{th}$ feature frame, where voicedness falls in a range from completely unvoiced speech to completely voiced speech. A voicing onset indicator, $p_{von}(j)$, can be determined as a pseudo-probability corresponding to a likelihood that the $j^{th}$ feature frame corresponds to an onset of voicing, where onset corresponds to a transition from unvoiced to voiced speech. Conversely, a voicing offset indicator, $p_{voff}(j)$, can be determined as a pseudo-probability corresponding to a likelihood that the $j^{th}$ feature frame corresponds to an offset of voicing, where offset corresponds to a transition from voiced to unvoiced speech.

In accordance with example embodiments, the voicing indicator can be computed as:

$$p_v(j) = \max\left\{0, \frac{[b_{RMS}(j) - \text{floor}(\min(b_{RMS}))]}{\text{range}}\right\}, \quad [1]$$

where $\min(b_{RMS})$ and $\max(b_{RMS})$ are the minimum and maximum values, respectively, of $b_{RMS}(j)$ determined over the entire range of s(i), $$\text{range}=\max\{1.0,\max[b_{RMS}]-\text{floor}[\min(b_{RMS})]\}, \quad [2]$$

and $$\text{floor}[\min(b_{RMS})]=\max[c_{floor},\min(b_{RMS})], \quad [3]$$

By way of example, the constant $c_{floor}=20.0$, although other values could be used.

At voicing onset, $b_{RMS}(j)$ will generally tend to be increasing. The voicing onset indicator $p_{von}(j)$ can therefore be determined using a scaled difference operator to sense the slope, while limiting the range of results according to $0\le p_{von}(j)\le 1$. More specifically, $p_{von}(j)$ may be computed as:

$$p_{von}(j)=\max\{0,\min[1.0,\Delta_b]\}, \quad [4]$$

where $$\Delta_b = \frac{b_{RMS}(j+i_{off}) - b_{RMS}(j-i_{off})}{c_s}, \quad [5]$$

$c_s$ is a slope factor, and $i_{off}$ is an index offset corresponding to an offset between frames used to sense the slope of $b_{RMS}(j)$. By way of example, $c_s=30.0$, although other values could be used. The index offset may be computed as $i_{off}=\max[1, \text{int}(c_{off}\times f_b)]$, where "int" is the integer function, and $c_{off}$ is an offset constant. A value of $c_{off}=0.02$ could be used, although other values are possible as well.

At voicing offset, $b_{RMS}(j)$ will generally tend to be decreasing. Therefore, following similar reasoning to that of voicing onset, the voicing offset indicator $p_{voff}(j)$ may be computed as:

$$p_{voff}(j)=\max\{0,\min[1.0,-\Delta_b]\}. \quad [6]$$

The candidate GCIs may be determined from the normalized, polarity-corrected LPC residuals, nr(i), by applying a set of criteria relating to peak values and pulse shape, where pulse shape can be evaluated by comparing neighboring samples of nr(i). More specifically, GCIs may be expected to be pulses with high amplitude compared to a background, and skewed in pulse shape such that they descend more slowly than they rise. As defined above the values of nr(i) may be considered as measuring standard deviations estimated locally in r(i). Accordingly, a sample of nr(i) may be considered a candidate GCI if it meets the following criteria:

$$nr(i)<-1.0,$$

$$[nr(i-1)>nr(i)] \text{ and } [nr(i)\le nr(i+1)],$$

$$[nr(i)<nr(i-p)] \text{ and } [nr(i)<nr(i+p)],$$

where $p=\text{int}(c_f\times f_s)$. The frequency constant $c_f$ could have a value of 0.0004, although other values could be used as well. All samples of nr(i) with values that meet these criteria may be considered a respective candidate GCI.

In addition, each such candidate GCI is ranked or scored with three measures of "goodness" of value, prominence, and skew, as follows:

$$q_{val}=q_1\times nr(i),$$

$$q_{prom}=q_2\times[q_3\times(nr(i+p)+nr(i-p)-nr(i))],$$

$$q_{skew}=q_4\times[nr(i+q_5)-nr(i-q_5)],$$

where example values of the constants are $q_1=-0.1$, $q_2=0.3$, $q_3$, =0.5, $q_4=0.1$, and $q_5=\text{int}(q_6\times f_s)$, with $q_6=0.00015$. It will be appreciated that different values could be used as well for any one or more of these constants.

Based on the criteria, a total of L<N candidate GCIs, gc(k), k=0, . . . , L−1 may be identified from among the N nr(i) samples. Each identified candidate GCI will have respective goodness scores for value, prominence, and skew, determined according to the ranking definitions above. In algorithmic terms, a respective data structure (e.g., organized storage) may be created for each respective candidate GCI gc(k). Each respective data structure may be used to record the information listed in Table 1.

TABLE 1

| Candidate GCI Data Structure: one per candidate GCI |
|---|
| gc(k) |
| $q(k) = q_{val} + q_{prom} + q_{skew}$ |
| frame index jk locating temporally closest frame, for associating voicing metric with gc(k) |
| sample residual index ik corresponding to index in nr(i) where gc(k) was identified |
| storage for normalized cross-correlation function |
| storage for pointer to previous and following candidate GCIs to be considered as actual glottal period endpoints |

The parameter q(k) in Table 1 corresponds to a GCI-quality score, and can be seen to include components of peak value as well as pulse shape. The normalized cross-correlation function (NCCF) is discussed below.

In accordance with example embodiments, a set of candidate F0s may be determined for each candidate GCI, gc(k), by respectively computing a normalized cross-correlation function of the mixture signal rs(i) centered at each residual index ik. That is, for each respective gc(k), the respective residual index ik locates the index in rs(i=ik) marking the center of a window over which a respective NCCF is computed. Each computation is carried out over a time window of width $w_{dur}$ centered at a respective residual index ik, and over a sequence of lag indices l in a range $l_1 \le l \le l_2$. The window duration is set so as to include enough signal samples to yield reasonable correlation estimates, while helping limit possible negative effects of including more than one GCI in the window. As an example, $w_{dur}$=0.0075 sec may be a suitable or appropriate value, although others may work as well. The range of lag indices can be set to correspond to a range of candidate F0s. More specifically, taking $F0_{max}$ and $F0_{min}$ as maximum and minimum values of F0 within which to search, the lag index range can be set according to $l_1=\text{int}(f_s/F0_{max})$ and $l_2=\text{int}(f_s/F0_{min})$. Since frequency is inverse to time, the lag indices correspond to sample time indices in rs(i). The NCCF for all the gc(k) can thus be computed as a two-dimensional array cc(k, l), where, for each gc(k), there are $l_2-l_1+1$ NCCF values.

For a sampling rate $f_s$, there will be $N_c=\text{int}(f_s \times w_{dur})$ samples spanning the time window. The NCCF may be centered at each residual index i=ik of rs(i) corresponding to a given gc(k) by performing a calculation over $N_c$ samples of rs(i) starting from index $i_1=ik-N_c/2$ to $i_2=i_1+N_c$. Taking cc(k, l) as the NCCF for gc(k) with residual index i=ik in rs(i), the NCCF may be expressed analytically as:

$$cc(k, l = l_1, \ldots, l_2) = \frac{\sum_{i=i_1}^{i_2} rs(i) \times rs(i+l)}{\sqrt{e_0 e_l}}; \quad \text{computed for } l = l_1, \ldots, l_2, \tag{7}$$

where $e_0$ and $e_1$ are given by:

$$e_0=\Sigma_{i=i_1}^{i_2} rs(i) \times rs(i), \text{ and} \tag{8}$$

$$e_l=\Sigma_{i=i_1}^{i_2} rs(i+l) \times rs(i+l). \tag{9}$$

The calculation may be carried out for each of the L candidate GCIs gc(k), k=, . . . , L−1, ultimately populating cc(k=0, . . . , L−1; $l=l_1, \ldots, l_2$) with NCCF values.

Next, for each gc(k), all local maxima in the NCCF with values above a threshold $c_{thresh}$ are identified as possible inverse F0 candidates. That is, each such value may mark a time period with respect to the sample time of gc(k) that corresponds to the inverse of a candidate F0. The lag index of each such identified NCCF peak value may be stored in two dimensional array of lag indices d(k,m), where m=0, . . . , P(k)−1. Since there may be a different number of NCCF values that meet the criteria for each gc(k), there may be a different number of lag indices for each k in d(k,m); this is captured in P(k), which may (though not necessarily) differ for each k. The maximum number may be given by $P_{max} \le l_2-l_1$.

The possible inverse F0 candidates indexed in d(k,m) may then be related to candidate F0s by how well they correlate with possible periods between successive candidate GCIs. Thus, for each gc(k), a comparison of the NCCF cc(k,d(k,m)), m=0, . . . , P(k)−1, with each of a subset of subsequent candidate GCIs may be used to evaluate the quality of each corresponding NCCF peak as a candidate F0. The subset of candidate GCIs against which the NCCF for a given k is compared is related to a range of expected F0s. More specifically, $l_1$ and $l_2$ may again be used to set a range of time sample indices, this time relative to the residual index ik corresponding to index in nr(i=ik) where gc(k) was identified. Taking ikn as a residual index in nr(i=ikn) of a next or subsequent GCI candidate gc(kn) following the candidate gc(k), the subset of candidate GCIs corresponds to all those for which $ik+l_1 \le ikn \le ik+l_2$.

For each subsequent GCI candidate gc(kn) so identified, an index differential $\Delta_{ik}$=ikn−ik corresponds to an interval to possible subsequent glottal closure. The inverse of this interval can therefore be taken to correspond to a possible F0 at the sample time indexed by ik. At the same time, cc(k,d(k,m)), m=0, . . . , P(k)−1, is constructed to contain inverse F0 candidates for gc(k), each at a lag index $l_m$=d(k,m), m=0, . . . , P(k)−1, relative to the sample time indexed by ik. In accordance with example embodiments, the lag index $l_{m=n}$ closest in value to $\Delta_{ik}$ may then be used to identify the best candidate F0 for gc(k). That is, the absolute difference $|\Delta_{ik}-l_m|$ is minimum for m=n (i.e., $l_m=l_{m=n}$), where $0 \le n \le P(k)-1$. The value of the NCCF peak at $l_{m=n}$ for gc(k) and this gc(kn) may be taken to define ccvn(k)=cc(k,d(k,m=n)).

The determination of each respective candidate GCI and each corresponding candidate F0 in this manner can be viewed as completing the third phase of the algorithm and beginning the fourth phase. More particularly, each of the determinations that complete the third phase can also be taken as forming a respective hypothesis of a concurrency of the respective candidate GCI and each of the corresponding candidate F0s. In the fourth phase, a lattice of alternative hypotheses is constructed based on each respective hypothesis of concurrency of a respective candidate GCI and each respective corresponding candidate F0. Each hypothesis is further extended to include a postulation of a voicing state. Each hypothesis may also include a cost based on one or more quality scores and/or cost functions, as described below.

The lattice can be considered as having two dimensions. One dimension is epoch (time), along which each hypothesized candidate GCI is located in temporal order. The other dimension is F0, along which the hypothesized candidate F0s associated with each hypothesized candidate GCI are located. Note the hypothesized candidate GCIs may not necessarily all have the same number of hypothesized candidate F0s. At each epoch in the lattice, all but one of the GCI-F0 hypotheses includes a postulation of voiced speech. One additional GCI-F0 hypothesis at each epoch includes a postulation of unvoiced speech. The lattice thus sets up an optimization problem for simultaneously optimizing GCI, F0, and voicing state of a speech signal.

In addition to hypothesizing the concurrency of a respective GCI, F0, and voicing state as determined in the third phase of the algorithm, each hypothesis also includes one or more measures, scores, or rankings of the hypothesized quantities. These may be used to determine a local cost for each hypothesis, which may be applied during optimization. Each hypothesis also includes "links" to temporally different hypotheses, where the links can be thought of as representing possible segments of progression across the temporal dimension of the lattice, in correspondence with the voice-production dynamics in the speech signal. Different paths across the lattice may be constructed from different sequences of connected inter-hypothesis links. A cost for each given path may be determined base on the costs of the hypotheses traversed by the given path, and the costs associated with the links in the given path. Determination of the path with the least cost, which may be considered optimal, occurs during the fifth phase of the algorithm (described later). Construction of the lattice in the fourth phase of the algorithm involves determining the various hypotheses, their associated local costs, and identification of their links.

In accordance with example embodiments, a local cost $c_{local}$ may be determined for each voiced-speech hypothesis based on the GCI-quality scores q(k) and q(kn) of gc(k) and gc(kn), the NCCF peak value ccvn(k), the duration of the period implied by $\Delta_{ik}$, a score for temporal proximity between gc(kn) and the inverse of F0, and the metric of degree of voicing ($p_v$, $p_{von}$, $p_{voff}$). By way of example, the local cost for voiced speech could be determined as:

$$c_{local}=[a_{peak}-ccvn(k)]+c_{GCI\text{-}period}+c_{voice}+q_{GCI\text{-}peak}+c_{period}+r. \quad [10]$$

Some of the quantities in $c_{local}$ have been described above, others are explained below.

The definition of the NCCF peak (or local maximum) ccvn(k) has been given above. The parameter $a_{peak}$ is a constant, which, by way of example, could be 1.0, although other values could be used.

A GCI-period score $c_{GCI\text{-}period}$ may be determined for each hypothesis as follows. The candidate GCIs included in each hypothesis corresponds to a respective gc(k), and a gc(kn) satisfying $ik+l_1 \le ikn \le ik+l_2$ for the respective gc(k). The difference $\Delta_{ik}-l_{m=n}$ may be used to determine the GCI-period score $c_{GCI\text{-}period}$ so as to quantify the quality of the corresponding candidate F0 in terms of a proximity of the inverse F0 to the implied period between gc(k) and a gc(kn). By way of example, the GCI-period score could be defined as:

$$c_{GCI-period} = w_{period} \times \left|\log\left(\frac{\Delta_{ik}}{l_{m=n}}\right)\right|, \quad [11]$$

where $w_{period}$ is a weighting constant. An example value of $w_{period}=1.0$ could be used, although other values are possible as well. Other quantitative definitions of $c_{GCI\text{-}period}$ are also possible.

A voiced-state cost $c_{voice}$ in equation [10] may be determined based on $p_v(jk)$, where jk as defined in Table 1 identifies the temporally closest frame to ik, and may thereby be used to associate voicing metric ($p_v$, $p_{von}$, $p_{voff}$) determined for the $jk^{th}$ feature frame with gc(k). More specifically, $c_{voice}$ may be defined according to $c_{voice}=w_{pv}\times[1.0-p_v(jk)]$, where the constant $w_{pv}$ may be set to 0.8, for example.

A GCI peak quality $q_{GCI\text{-}peak}$ in equation [10] may be determined based on the definition of q(k) in Table 1, applied to g(k) and g(kn). More particularly, the GCI peak quality may be defined according to the fraction $q_{GCI\text{-}peak}=w_{peak}/[q(k)+g(kn)]$, where the numerator constant may be set as $w_{peak}=1.3$, for example.

A period cost $c_{period}$ in equation [10] may be determined as $\Delta_{ik}$ scaled by a weighting factor. Specifically, the period cost may be set as $c_{period}=s_{period}\times\Delta_{ik}$, where $a_{period}=0.0002$, for example. During voiced speech, measures of hypothesis quality for integer multiples of a true glottal period may tend to have similar values. The period cost may help favor shorter periods, and thereby increase the likelihood of identifying a true period.

Finally, a reward r in equation [10] may be set as a constant r=−1.5. The larger the negative value of r, the higher the density of GCIs.

With the definitions above, the local cost $c_{local}$ given by equation [10] may be seen to have components that depend on both residual peak quality and the value of the NCCF at the hypothesize F0 period.

In preparation for dynamic programming carried out in the fifth phase of the algorithm, organized storage may be created for each hypothesis that includes a postulation of voiced speech. For implementation in the form of a computer program (or other form of executable machine language), the organize storage could be a data structure, for example. For each epoch in the lattice, additional storage (e.g., a data structure) may be created for a hypothesis for that includes a postulation of unvoiced speech, as described below. An example of the organization of each voiced hypothesis data structure is illustrated in Table 2.

TABLE 2

| GCI-F0-Voiced Hypothesis Data Structure: one per voiced hypothesis |
|---|
| vs = 1, the hypothesized voicing state (1 ⇒ voiced speech) |
| GCI period = $\Delta_{ik}$, the hypothesized period |
| F0 period = $l_{m=n}$, lag of NCCF peak closest to GCI period |
| $c_{local}$, local cost (as described) |
| start_peak = k |
| end_peak = kn |
| $c_{sum}$ = 0.0, cumulative cost tallied during dynamic programming (initialized to zero) |
| best_previous_candidate = −1, for backpointers during dynamic programming (initialized) |

The voicing state vs=1 corresponds to the hypothesis that the speech is voiced. Other parameters are used during dynamic programming, as described below.

In creating the data structures for the hypotheses of the lattice, information is added to each hypothesis data structure that links the respective hypothesis of the data structure with possible past and future GCI peaks. More particularly, a link is added that identifies the next (future) GCI peak to which the hypothesis may connect by virtue of the hypothesized GCI period. One or more links may also be added that identify all previous (past) GCI peaks that may connect to the GCI peak of respective hypothesis by virtue of the hypothesized GCI periods associated with those previous (past) GCI peaks. For implementation in the form of a computer program, the links may take the form of pointers, for example.

As a completing operation of creating the data structures for the hypotheses of the lattice, the local cost $c_{local}$ of all the voiced hypotheses at each given epoch are compared, from which the voiced hypothesis with the lowest cost at each given epoch may be identified. At each given epoch of the lattice, corresponding to a given GCI peak gc(k), the voiced hypothesis with the lowest cost is then used as sort of template for an unvoiced hypothesis at the given epoch. More particularly, a data structure (or other form of organized storage) for an unvoiced hypothesis may be created. An example of the organization of an unvoiced hypothesis data structure is illustrated in Table 3.

TABLE 3

| GCI-F0-Unvoiced Hypothesis Data Structure: one per GCI epoch |
|---|
| vs = 0, the hypothesized voicing state (0 ⇒ unvoiced speech) |
| GCI period = $\Delta_{ik}$, the hypothesized period |
| F0 period = $l_{m-n}$, lag of NCCF peak closest to GCI period |
| $c_{U\text{-}local}$, local cost for unvoiced speech (as described below) |
| start_peak = k |
| end_peak = kn |
| $c_{sum}$ = 0.0, cumulative cost tallied during dynamic programming (initialized to zero) |
| best_previous_candidate = −1, for backpointers during dynamic programming (initialized) |

The voicing state vs=0 corresponds to the hypothesis that the speech is unvoiced. The local cost for unvoiced speech, $c_{U\text{-}local}$, may differ form that for voiced speech. By way of example, the local cost for unvoiced speech could be determined as:

$$c_{U\text{-}local}=w_{uv}\times ccvn(k)+c_{pv}+c_{uv}+q_{GCI\text{-}peak}+r. \quad [12]$$

Some of the quantities in $c_{U\text{-}local}$ have been described above in connection with $c_{local}$, others are explained below.

The weighting factor $w_{uv}$ may be set to 0.9, although other values could be used. The component $c_{pv}$ may be given by $c_{pv}=w_{pv}\times p_v(jk)$, where the constant $w_{pv}$ is defined above in connection with $c_{voice}$. Also as described above, jk again identifies the temporally closest feature frame to ik, and may thereby be used to associate voicing metric ($p_v$, $p_{von}$, $p_{voff}$) determined for the $jk^{th}$ feature frame with gc(k). The unvoiced-state cost $c_{uv}$ may be taken as constant; an example value could be $c_{uv}$=0.9. The reward r is as defined above for $c_{voice}$.

Once the lattice of alternative hypotheses is constructed in accordance with example embodiments, as described above, the dynamic programming of the fifth phase of the algorithm may be carried in order to determine a least-cost path through the lattice. A general outline of this procedure is described below. A detailed description is omitted here, since techniques of dynamic programming are generally known.

As described above, each epoch of the lattice corresponds to a different one of the hypothesized GCI peaks recorded in gc(k), k=0, . . . , L−1. Each hypothesis at a given epoch may have an identified link (e.g., pointer) to one subsequent GCI peak at a subsequent epoch, and one or more earlier GCI peaks back to one or more earlier epochs. Each hypothesis includes either a local cost given by $c_{local}$ for (hypothesized) voiced speech (vs=1), or $c_{U\text{-}local}$ for (hypothesized) unvoiced speech (vs=0).

For each hypothesis at a given epoch, a combined hypothesis-link cost for every link back to an earlier epoch may be determined. The combined hypothesis-link cost for a given link may include a contribution from the local cost ($c_{local}$ or $c_{U\text{-}local}$) and a transition-cost contribution corresponding to a transition from the earlier epoch to which the given link connects. Since each link back to an earlier epoch is a link to a hypothesis at that earlier epoch, the link may be considered to entail a transition between the voicing state of the hypothesis at the earlier epoch and the voicing state of the hypothesis at the given epoch. Four types of transitions may be considered: voiced→voiced, voiced→unvoiced, unvoiced→voiced, and unvoiced→unvoiced. As described below, the cost of each link may differ based on the type of transition, as well as scores and rankings of the hypothesis at the given epoch.

In accordance with example embodiments, the hypothesis-link cost with the least cost may be used to respectively identify a "favored" backward link for each hypothesis at a given epoch and the hypothesis-link cost for that favored backward link. Once all such favored backward links for all hypotheses of the lattice are determined, they may be arranged in one or more connected sequences that correspond to one or more paths through the lattice, each path traversing a given epoch just once. Each path may have a path cost that depends on the connected links in the path. The path with the least cost from among the one or more paths may then be considered an optimal path that identifies a best estimate of a temporal sequence of GCIs, F0, and voicing states represented in the original speech signal.

In further accordance with example embodiments, the four types of transition costs may be determined based on parameters of the hypotheses connected by the links. More particularly, the transition costs for a voiced→voiced link, an unvoiced→voiced link, a voiced→unvoiced link, and an unvoiced→unvoiced link may be respectively given as:

$$c_{v\to v} = w_{F0-trans}\times\left|\log\left(\frac{\Delta_{ik}}{\Delta_{ik-1}}\right)\right|, \quad [13a]$$

$$c_{uv\to v} = w_{v-trans}\times[1.0 - p_{von}(jk)], \quad [13b]$$

$$c_{v\to uv} = w_{v-trans}\times[1.0 - p_{voff}(jk)], \quad [13c]$$

$$c_{uv\to uv} = 0, \quad [13d]$$

where $\Delta_{ik}$=ikn−ik, as described above, and $\Delta_{ik\text{-}1}$=ik−ik−1 corresponds to the period between the GCI at the given epoch and the GCI at the previous epoch from which the transition occurs. The constant $w_{F0\text{-}trans}$=1.8 could be used, for example, and the constant $w_{v\text{-}trans}$=1.4 could be used, for example.

It will be appreciated that various algorithmic techniques may be used to keep track of combined hypothesis-link costs for each hypothesis, and to determine a lowest hypothesis-link cost for each F0 hypothesis at each given epoch.

Once the least-cost path through the hypotheses of the lattice has been determined, it may be traversed backward in order to identify an optimal set of GCIs from the sequence of hypotheses connected by way of the least-cost path. This backtracking procedure is carried out as part of the sixth phase of the algorithm. In accordance with example embodiments, the GCIs identified by backtracking across the least-cost path may be considered as a best estimate of true GCIs that occur during production of the original speech signal. In further accordance with example embodiments, the inverse of the identified GCI at each given epoch may be taken as an estimate of the true F0 at that given epoch. Each F0 estimate may be further refined by reference to a closest matching NCCF peak from among the NCCF peaks associated with the GCI at each given epoch. Similarly, the voicing states (voiced or unvoiced) of the hypotheses connected by way of the least-cost path may be considered as best estimates of the true voicing states at the epochs of the optimal GCIs. Thus, the example algorithm may be seen as simultaneously estimating GCIs, F0s, and voicing states of a speech signal.

Figure 7:
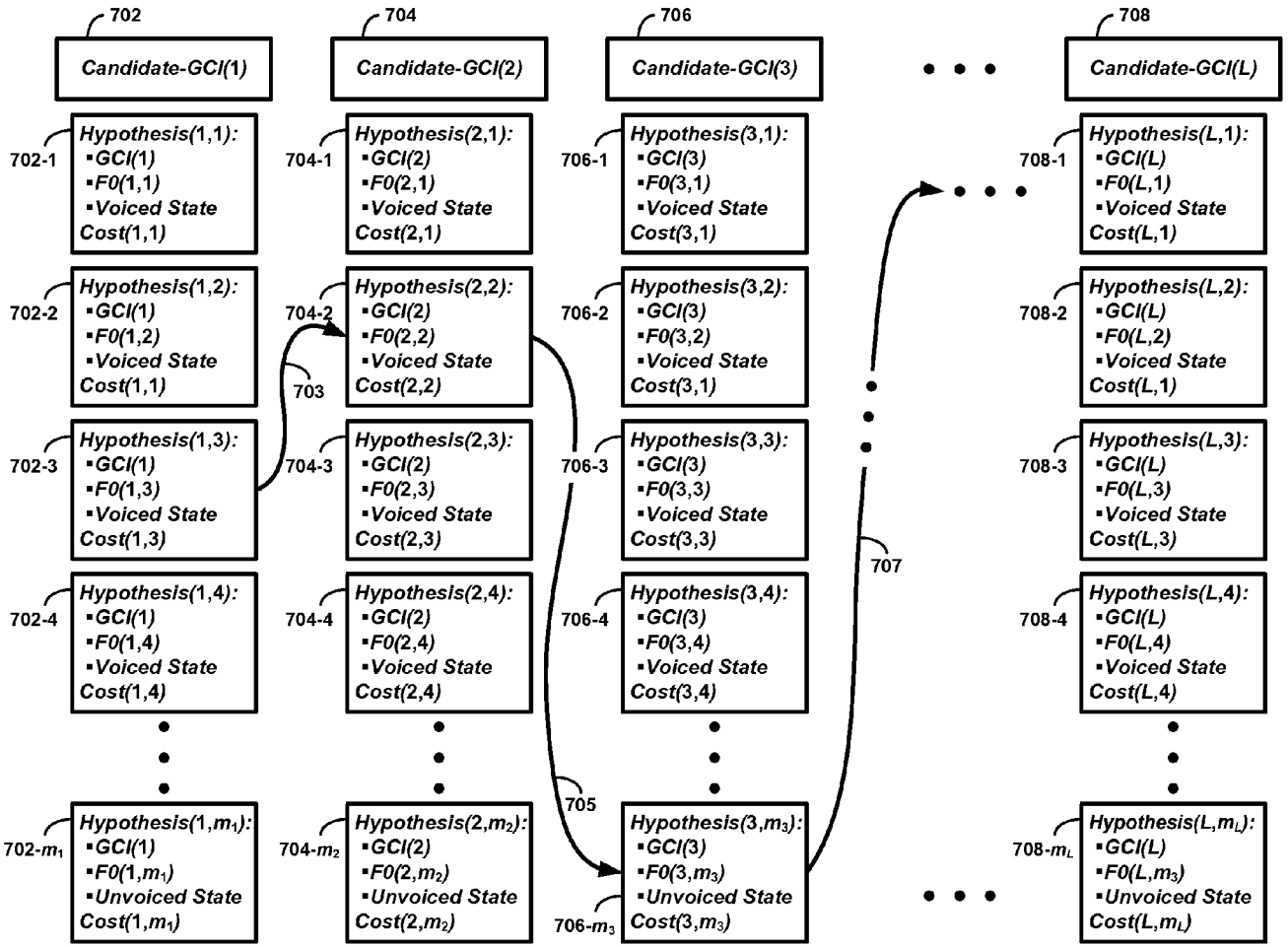
FIG. 7 is a schematic depiction of an example lattice of hypotheses of concurrent glottal closure instants, F0s, and voicing states, in accordance with an example embodiment.

A conceptual illustration of the lattice and example connections between hypotheses at different epochs is shown in FIG. 7. By way of example, four epochs, 702, 704, 706, and 708, are depicted along the horizontal direction. In the illustration, there could be additional epochs between epochs 706 and 708, as indicated by the intervening ellipses. The epoch 702 is marked by a candidate GCI labeled "Candidate-GCI (1)," where the index "1" indicates that this is the first candidate GCI of an example sequence of candidate GCIs. Similarly, epoch 704 is marked by a candidate GCI labeled "Candidate-GCI(2)," and epoch 706 is marked by a candidate GCI labeled "Candidate-GCI(3)." The epoch 708 is marked by a candidate GCI labeled "Candidate-GCI(L)," where the index L indicates the last candidate GCI of the example sequence.

A set of hypotheses, 702-1, 702-2, 702-3, 702-4, and 702-$m_1$, is constructed at the epoch 702, and depicted along the vertical direction in the figure. Each hypothesis includes a concurrency of the candidate GCI at the epoch 702, a candidate F0, a voicing state, and a local cost. For example, the hypothesis 702-1, labeled "Hypothesis (1,1)," includes a concurrency of Candidate-GCI(1), F0(1,1), Voiced State, and Cost(1,1). Similarly, the hypothesis 702-2, labeled "Hypothesis (1,2)," includes a concurrency of Candidate-GCI(1), F0(1,2), Voiced State, and Cost(1,2); the hypothesis 702-3, labeled "Hypothesis (1,3)," includes a concurrency of Candidate-GCI(1), F0(1,3), Voiced State, and Cost(1,3); the hypothesis 702-4, labeled "Hypothesis (1,4)," includes a concurrency of Candidate-GCI(1), F0(1,4), Voiced State, and Cost(1,4). As shown, the last hypothesis of the set, 702-$m_1$, labeled "Hypothesis (1,$m_1$)," corresponds to an unvoiced state, and includes a concurrency of Candidate-GCI(1), F0(1,$m_1$), Unvoiced State, and Cost(1,$m_1$).

A similar explanation applies to hypotheses at the epochs 702, 704, 706, and 708, except that the first index of each hypothesis identifies the index of the epoch. For example, the hypothesis 704-1, labeled "Hypothesis (2,1)," includes a concurrency of Candidate-GCI(2), F0(2,1), Voiced State, and Cost(2,1), and so on. Note that there can be a different number of hypotheses as each epoch. Thus, the last index at each epoch in this illustration is labeled $m_1$, $m_2$, $m_3$, and $m_L$, respectively. Each of these could be different, although not necessarily.

In the example of FIG. 7, curved arrows represent links or connections between hypotheses at different epochs, along what may be considered for purposes of illustration a least-cost path. For example, the link 703 is shown as connecting Hypothesis(1,3) at the epoch 702 with Hypothesis (2,2) at the epoch 704. By way of example, the link 703 corresponds to a voiced→voiced transition. Similarly, the link 705 is shown as connecting Hypothesis(2,2) at the epoch 704 with Hypothesis (3,$m_3$) at the epoch 706. Also by way of example, the link 705 corresponds to a voiced→unvoiced transition. Finally, the link 707 is shown as connecting Hypothesis(3,$m_3$) at the epoch 706 with Hypothesis (L,1) at the epoch 708. Again by way of example, the link 707 corresponds to an unvoiced→voiced transition. The ellipses in the link 707 suggest that there could be other transitions between the epoch 706 and 708 corresponding to possible additional epochs, omitted from the figure for the sake of brevity.

In the example illustration of FIG. 7, an optimal set of GCIs, F0s, and voicing state could be identified by backtracking across the connected hypotheses in the lattice. Note that in an actual application of the example algorithm to a particular speech signal, there may be candidate GCIs that are skipped or omitted from the least-cost path, just as there may be candidate F0s at a given epoch that turn out not be part of the least-cost path. The apparent connection of successive candidate GCIs in FIG. 7 may therefore considered as illustrative and not necessarily requiring inclusion of the candidate GCI at every epoch of the lattice.

An example of an application of simultaneously estimated GCIs, F0s, and voicing states of a speech signal in accordance with example embodiments may be illustrated in the context of speech synthesis. More particularly, in concatenation-based speech synthesis, short segments of prerecorded speech are concatenated to generate a desired utterance of synthesized speech. The prerecorded segments may be stored in a speech database, and each may include a respective phonetic label that identifies its phonetic content. Each speech segment and its phonetic label, possibly as well as other, ancillary information, is referred to as a "speech unit." The collection of speech units in the database may be viewed a sort of toolkit of recorded speech elements that may be analytically "mixed and matched" in order to construct synthesized speech corresponding to specified input, such as a text string.

More particularly, a concatenation-based synthesis system may operate by translating input text into a sequence of phonetic labels, possibly including contextual (or other) information, which can be used to identify and select, by one or another set of criteria, a sequence of speech units from the speech database. The recorded speech segments from the selected speech units can then concatenated into a synthesized waveform, and the waveform played out as the synthesized speech corresponding to the input text string. As described below, the process of selecting speech units may be made more reliable by the inclusion of F0 and voicing state among the ancillary information in each speech unit of the database. Moreover, concatenating speech segments of the selected units so as to generate natural sounding speech may be significantly aided by inclusion (or identification) of GCIs of the speech segments in the speech units of the database.

Figure 8:
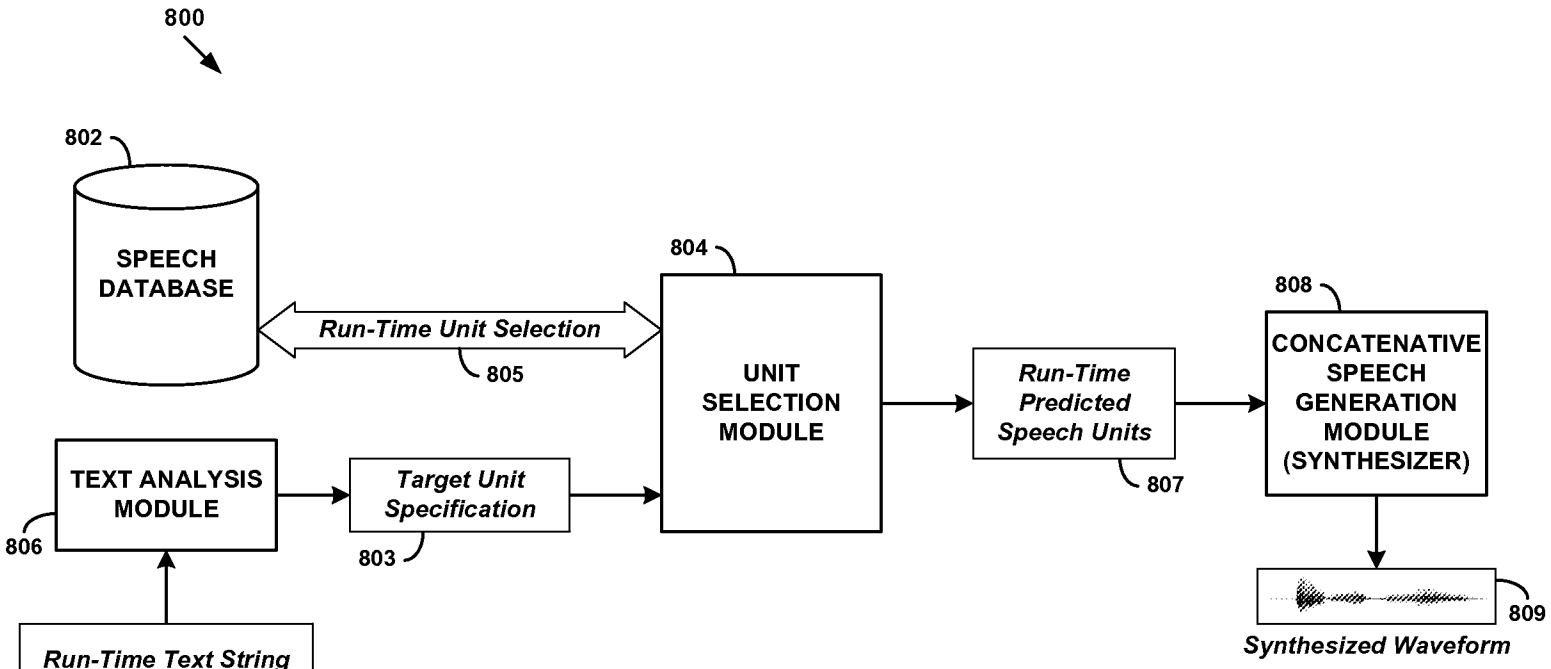
FIG. 8 depicts a block diagram of a speech synthesis system, in accordance with an example embodiment.

FIG. 8 depicts a block diagram of an example speech synthesis system 800 in which an example embodiment of speech synthesis using simultaneously determined GCIs, F0s, and voicing state could be applied. In addition to functional components, FIG. 8 also shows selected example inputs, outputs, and intermediate products of example operation. The functional components of the speech synthesis system 800 include a speech database 802, a unit selection module 804, a text analysis module 806, and a concatenative speech generation module (speech synthesizer) 808. These functional components could be implemented as machine-language instructions in a centralized and/or distributed fashion on one or more computing platforms or systems, such as those described above. The machine-language instructions could be stored in one or another form of a tangible, non-transitory computer-readable medium (or other article of manufacture), such as magnetic or optical disk, or the like, and made available to processing elements of the system as part of a manufacturing procedure, configuration procedure, and/or execution start-up procedure, for example.

A speech synthesis system, such as system 800, may be prepared for run-time operation with run-time input (e.g., run-time text strings) by populating the database with speech units, and tuning or "training" the unit selection procedure to do a good job of unit selection (where "good" may be defined by one or more specific measures, for example). A general outline of the preparation and training operations is described below.

In accordance with example embodiments, speech recitations may be recorded by a human who follows (e.g., reads) textual scripts. In practice, the speech recitations may be digitized and recorded as collections (e.g., data files) of digital samples. A computer-readable pronunciation dictionary may be used to automatically convert each textual script into an equivalent (or corresponding) sequence of phonetic units (e.g., phonemes), each having a unit label.

Speech recognition technology (e.g., a speech recognition system) may then be used to automatically align the phonetic units with the corresponding recorded digital speech recitation (or portion thereof, for example). In this way, boundaries between the phonetic units of the sequence may be identified as a sequence of time marks across the sequence of digital samples that make up the recorded recitation. The time marks may then serve to delineate labeled sub-segments of the digital sequence that correspond to respective, labeled phonetic units. For convenience in the present discussion, the labeled sub-segments may be referred to as "source units," and the recorded recitation as "source speech."

For every source unit identified, an associated speech unit may then be generated and stored in the speech database. Each speech unit may include time marks that delineate the associated source unit. In this way, each speech unit may be associated with a unit of recorded speech by virtue of an identified sub-segment of the recorded source speech. Thus, each speech unit may not necessarily include an actual copy of the digital samples of the associated source unit, but rather two (or possibly more) time marks that delineate a sub-sequence of recorded digital samples of the source speech.

In further accordance with example embodiments, the source speech may also serve as input to other forms of analysis, including simultaneously determination of GCIs, F0s, and voicing state in a manner described above. In particular, such determinations may be used help refine identification of phone boundaries. Additional analysis may be used to determine energy (e.g., loudness) of the source speech, as well as various spectral measures that may be further used later to help match unit boundaries at run-time. Context information, such as word identity, syllable position, phrase position, etc., may also be determined. Some or all of the above information (and possibly other information about the source speech as well) may be included in the speech units derived for the recorded source speech, along with the time marks described above. In particular, each speech unit may include GCIs, F0s, and voicing state identification specific to the speech unit. The above process may be carried out for multiple speech recitations. The larger the number, the larger the speech database (e.g., speech database 802), and the larger the body of speech units available during run-time synthesis.

Referring again to FIG. 8, a run-time text string 801 may be input to the text analysis module 806 during run-time speech synthesis. The text analysis module 806 analyzes the run-time text string 801 and thereby generates a target unit specification 803, which represents the speech that should be synthesized. In accordance with example embodiments, the target unit specification 803 may include most or all of the attributes that can be inferred from the text, possibly including some features or combinations of features that might not identically exist in the speech database 802.

The target unit specification 803 is then input to the unit selection module 804, which performs run-time unit selection 805 to identify and select units from the speech database 802 that represent a determination of speech units from which speech corresponding to the run-time text string 801 may be synthesized. The speech units selected in this manner form run-time predicted speech units 807 output by the unit selection module 804.

Various unit selection techniques could be used. As one example, a matrix can be constructed in which the columns, corresponding to the target unit specification 803, contain labels of exact or approximately matching phonetic unit labels in the database. Dynamic programming across this matrix of variable length columns may be applied to find a lowest cost (best match) path. Target costs in this search can be feature-based differences between prospective, target speech units from the database 802 and the target unit specification 803. Transition costs may be computed from features including F0 and spectrum-shape measured at endpoints of the prospective speech units that would be joined (i.e., concatenated). Voicing state may also be used in unit selection by examining context information that may be associated with the target unit specification 803. Finally, backtracking may be carried out to extract the "best" sequence of speech units, which corresponds to the run-time predicted speech units 807 in the illustration in FIG. 8.

Other examples of unit selection techniques could include statistical modeling base on hidden Markov models (HMMs), machine learning, for example using neural networks (NNs), and hybrid techniques using both HMMs and NNs. During training time, the unit selection module 804 may be trained or tuned to generate reliable and/or accurate results based on known inputs.

The run-time predicted speech units 807 are next input to the concatenative speech generation module (speech synthesizer) signal generation module 808, which may then synthesize a run-time waveform 809. The run-time waveform 809 may thereby be a concatenation of speech segments of the run-time predicted speech units 807 that can be played out by an audio output device, for example.

The quality or naturalness of the sound of run-time waveform 809 can depend, at least in part, on how well connection points of adjacent speech segments of the concatenated sequence match and fit together. The quality of the segment-to-segment connections can be improved by aligning the connection points at GCIs of the segments. The more accurate the GCIs of the speech segments, the better the quality of the alignments and connections. Accordingly, the concatenative speech generation module (speech synthesizer) signal generation module 808 may apply the GCIs and F0s of the run-time predicted speech units 807 to facilitate high-quality, concatenation-based speech synthesis.

More specifically, matching GCIs at the boundaries my lead to smooth join points. In addition, the human ear is very sensitive to unnatural discontinuities in F0 (on the order of 1% change in F0). Accordingly, selection speech units that have very similar F0 values on either endpoint to be joined can help reduce or eliminate detectable discontinuities.

Figure 9:
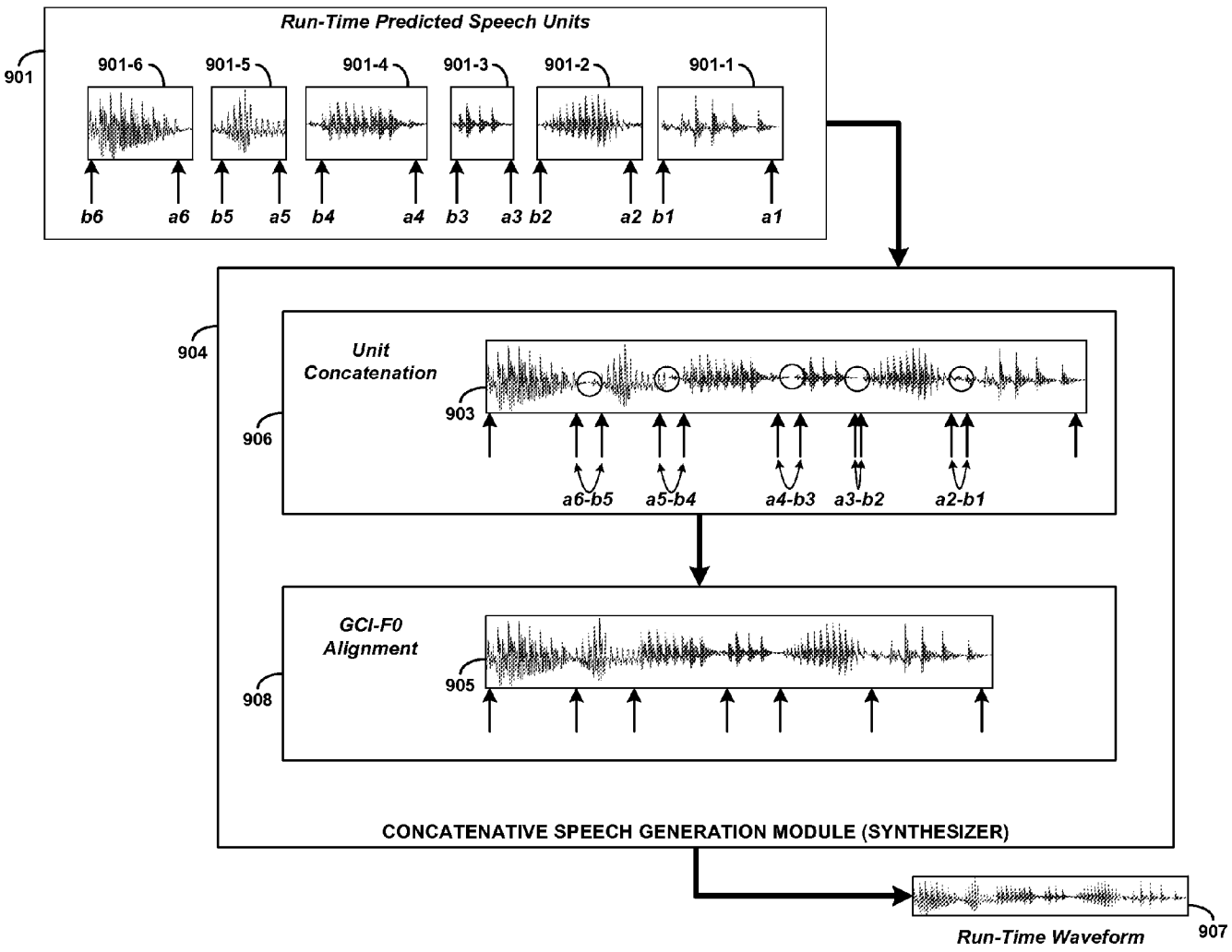
FIG. 9 is a conceptual illustration of unit concatenation employing information from glottal closure instants and F0s, in accordance with an example embodiment.

FIG. 9 is a conceptual illustration of unit concatenation employing GCIs. A sequence 901 of run-time predicted speech units is input to a concatenative speech generation module (speech synthesizer) 904. By way of example, the sequence 901 includes speech units 901-1, 901-2, 901-3, 901-4, 901-5, and 901-6, each of which is depicted by a cartoon-like rendering of a segment of a digitized speech. The particular forms of the signals in the speech units are illustrative, and do not necessarily depict actual speech signals. Each speech unit includes two GCIs labeled "a" and "b" and marked by respective vertical arrows. Specifically, speech unit 901-1 includes GCIs a1 and b1; speech unit 901-2 includes GCIs a2 and b2; speech unit 901-3 includes GCIs a3 and b3; speech unit 901-4 includes GCIs a4 and b4; speech unit 901-5 includes GCIs a5 and b5; and speech unit 901-6 includes GCIs a6 and b6. There could be other GCIs associated with the speech unit, but only two are shown for each for the sake of brevity.

A unit concatenation module 906 in the speech generation module 904 generates an unaligned concatenated sequence 903 from the input sequence 901. Unaligned connection points of the unaligned concatenated sequence 903 are shown with circles, and positions of the unaligned GCIs at each unaligned connection point are labeled and marked with vertical arrows. By way of example, the unaligned connection point between speech units 901-1 and 901-2 is marked by two vertical arrows corresponding to GCIs b1 and a2. Similar pairs of GCIs of adjacent speech units are also shown. If the unaligned concatenated sequence 903 were played out as is, there might be unnatural sounding artifacts, such as "clicks," or acoustic gaps, due to the unaligned connection points.

The unaligned concatenated sequence 903 is next input to a GCI-F0 alignment module 908, which generates an aligned concatenated sequence 905. Alignment in this conceptual illustration corresponds to temporal alignment of successive speech units GCI boundaries. For example, speech units 901-1 and 901-2 are aligned so that GCI b1 and GCI a2 align at a common sample time. Similarly, speech units 901-2 and 901-3 are aligned so that GCI b2 and GCI a3 align at a common sample time; speech units 901-3 and 901-4 are aligned so that GCI b3 and GCI a4 align at a common sample time; speech units 901-4 and 901-5 are aligned so that GCI b4 and GCI a5 align at a common sample time; and speech units 901-5 and 901-6 are aligned so that GCI b5 and GCI a6 align at a common sample time. The resulting aligned concatenated sequence 905 may then be output as the run-time waveform 907. Because of the alignment possible using accurate GCIs, the run-time waveform 907 may sound like natural speech when played out.

It should be noted that the discussion in this section, and the accompanying figures, are presented for purposes of example. Other system arrangements, including different components, different relationships between the components, and/or different processing, may be possible.

CONCLUSION

An illustrative embodiment has been described by way of example herein. Those skilled in the art will understand, however, that changes and modifications may be made to this embodiment without departing from the true scope and spirit of the elements, products, and methods to which the embodiment is directed, which is defined by the claims.

What is claimed is:

1. A method comprising:

receiving, by a system including one or more processors, a speech signal comprising a first temporal sequence of speech-signal samples, each speech-signal sample having a sample time;

processing the received speech signal with the one or more processors to determine (i) a second temporal sequence of candidate glottal closure instants (GCIs), each candidate GCI corresponding to a respective sample time in the first temporal sequence, (ii) for each respective candidate GCI of the second temporal sequence, a respective set of candidate fundamental frequencies (F0s) of the speech signal at the respective sample time corresponding to the respective candidate GCI, and (iii) for each respective candidate GCI of the second temporal sequence, a metric of voicing degree of the speech signal at the respective sample time corresponding to the respective candidate GCI;

for each respective candidate GCI of the second temporal sequence, determining an objective function for each respective candidate F0 of the respective set, wherein the objective function comprises a respective hypothesis that postulates simultaneous occurrence of all three of the respective candidate GCI, the respective candidate F0, and a voicing state of the speech signal, and wherein the respective hypothesis includes a GCI-period score for a correspondence between the respective candidate F0 and a subsequent candidate GCI of the second temporal sequence;

for each respective candidate GCI of the second temporal sequence, determining a cost for each respective hypothesis based, at least, on both the GCI-period score and the metric of voicing degree at the respective sample time corresponding to the respective candidate GCI;

determining a sequence of hypotheses corresponding to a least-cost path through the candidate GCIs, wherein the sequence of hypotheses includes at most one respective hypothesis associated with each candidate GCI;

backtracking through the least-cost path to determine a cost-optimal set of GCIs of the received speech signal, processing the received speech signal into a sequence of phonetic units, each of the phonetic units comprising a sub-sequence of the first temporal sequence and an identifying label;

marking sample times of each phonetic unit that correspond to GCIs of the cost-optimal set;

storing each phonetic unit, including marked sample times, in a speech-synthesis database; and with a speech synthesizer device, synthesizing speech of a concatenation of stored phonetic units, the concatenation including at least one of the marked phonetic units.

2. The method of claim 1, wherein determining the cost-optimal set of GCIs of the received speech signal comprises determining a cost-optimal F0 for at least one GCI of the cost-optimal set.

3. The method of claim 1, wherein the speech-signal samples are digitized measurements of a speech waveform, and wherein receiving the speech signal by the system comprises receiving the speech waveform from a source, wherein the source is one of a real-time waveform or a pre-recorded waveform.

4. The method of claim 1, wherein processing the received speech signal with the one or more processors to determine the second temporal sequence of candidate GCIs comprises:

determining linear predictive code (LPC) residuals of the speech signal, each at a respective sample time in the first temporal sequence;

determining normalized LPC residuals by normalizing a function of the LPC residuals by a root-mean-square (RMS) measure of at least a subset of the function of the LPC residuals;

identifying sub-sequences of consecutive values of the normalized LPC residuals, each sub-sequence of which has both a respective peak magnitude normalized LPC residual value that exceeds a LPC residual threshold and a respective pulse shape relative to a sample time of the respective peak magnitude normalized LPC residual value that satisfies a set of pulse-shape criteria;

determining a respective GCI-quality score for each respective identified sub-sequence based on the respective peak magnitude normalized LPC residual value and on the respective pulse shape of the respective identified sub-sequence; and for each respective identified sub-sequence, associating the respective GCI-quality score and the sample time of the respective peak magnitude normalized LPC residual with a respective one of the candidate GCIs.

5. The method of claim 4, wherein processing the received speech signal with the one or more processors to determine the respective set of candidate F0s of the speech signal at the respective sample time corresponding to the respective candidate GCI comprises:

determining a linear combination of the first temporal sequence and of the LPC residuals;

determining a normalized cross-correlation function (NCCF) of the linear combination, wherein the NCCF is centered at the respective sample time corresponding to the respective candidate GCI, and computed for sample times within a time window corresponding to a range of F0 values from a minimum F0 value to a maximum F0 value;

identifying peak NCCF values of the respective NCCF that exceed a NCCF threshold value; and associating a sample time of each of the identified peak NCCF values with a respective one of the candidate F0s.

6. The method of claim 1, wherein processing the received speech signal with the one or more processors to determine the metric of voicing degree of the speech signal at the respective sample time corresponding to the respective candidate GCI comprises:

subdividing the first temporal sequence into sequential frames of speech-sample signals, each of the sequential frames having a respective frame time;

determining a band-limited root-mean-square (RMS) value of speech-sample signals within each of the sequential frames;

based on the determined band-limited RMS value of each of the sequential frames, determining, for each of the sequential frames, a respective voicing indicator value, a respective voicing onset indicator value, and a respective voicing offset indicator value;

identifying, from among the sequential frames, a particular frame having a frame time closest to the respective sample time corresponding to the respective candidate GCI; and associating the respective voicing indicator value, the respective voicing onset indicator value, and the respective voicing offset indicator value of the particular frame with the respective candidate GCI.

7. The method of claim 1, wherein determining the objective function for each respective candidate F0 of the respective set comprises:

for each respective candidate F0 of the respective set, constructing a hypothesis of a concurrence of the respective candidate GCI and the respective candidate F0;

for each constructed hypothesis, determining the GCI-period score;

for each constructed hypothesis, further hypothesizing that the speech signal is in a voiced state at the respective sample time corresponding to the respective candidate GCI; and for at least one constructed hypothesis, further hypothesizing that the speech signal is in an unvoiced state at the respective sample time corresponding to the respective candidate GCI.

8. The method of claim 7, wherein determining the GCI-period score comprises:

determining a respective time period based on an inverse of the respective candidate F0;

determining a predicted GCI corresponding to the respective candidate F0 by adding the respective time period to the respective sample time corresponding to the respective candidate GCI; and determining a respective proximity score for the respective candidate F0 based on a temporal proximity of the predicted GCI to the subsequent candidate GCI of the second temporal sequence.

9. The method of claim 5, wherein determining the cost for each respective hypothesis comprises:

determining a respective NCCF-peak score for the respective candidate F0 based on the peak NCCF value associated with the respective candidate F0;

merging the GCI-period score, the metric of voicing degree of the speech signal at the respective sample time corresponding to the respective candidate GCI, the respective GCI-quality score, and the respective NCCF-peak score;

if the respective candidate GCI is not the temporally-first candidate GCI of the second temporal sequence, determining a temporally prior candidate GCI based on a prior candidate F0 associated with the temporally prior candidate GCI; and if the respective candidate GCI is not the temporally-last candidate GCI of the second temporal sequence, determining a temporally subsequent candidate GCI based on the respective candidate F0.

10. The method of claim 9, wherein determining the sequence of hypotheses corresponding to a least-cost path through the candidate GCIs comprises:

determining a directed graph comprising all connections between candidate GCIs, wherein each of the connections corresponds to a respective period between a temporally-earlier candidate GCI and a temporally-later candidate GCI, and wherein the respective period corresponds to an inverse of the candidate F0 of a given one of the hypotheses of the temporally-earlier candidate GCI;

determining every path through the directed graph that traverses each candidate GCI at most once;

determining a respective cumulative cost of all hypotheses traversed by each determined path; and selecting the determined path corresponding to the smallest cumulative cost.

11. The method of claim 10, wherein backtracking through the least-cost path to determine the cost-optimal set of GCIs of the received speech signal comprises identifying all candidate GCIs traversed by the selected determined path.

12. The method of claim 1, wherein determining the sequence of hypotheses corresponding to a least-cost path through the candidate GCIs comprises applying dynamic programming to a directed graph comprising connections between hypotheses of all pairs of one temporally-earlier candidate GCI and one temporally-later candidate GCI.

13. A method comprising:

receiving, by a system including one or more processors, a speech signal comprising a first temporal sequence of speech-signal samples, each speech-signal sample having a sample time;

processing the received speech signal with the one or more processors to determine (i) a second temporal sequence of candidate glottal closure instants (GCIs), each candidate GCI corresponding to a respective sample time in the first temporal sequence, (ii) for each respective candidate GCI of the second temporal sequence, a respective set of candidate fundamental frequencies (F0s) of the speech signal at the respective sample time corresponding to the respective candidate GCI, and (iii) for each respective candidate GCI of the second temporal sequence, a metric of voicing degree of the speech signal at the respective sample time corresponding to the respective candidate GCI;

for each respective candidate GCI of the second temporal sequence, determining an objective function for each respective candidate F0 of the respective set, wherein the objective function comprises a respective hypothesis that postulates simultaneous occurrence of all three of the respective candidate GCI, the respective candidate F0, and a voicing state of the speech signal, and wherein the respective hypothesis includes a GCI-period score for a correspondence between the respective candidate F0 and a subsequent candidate GCI of the second temporal sequence;

for each respective candidate GCI of the second temporal sequence, determining a cost for each respective hypothesis based, at least, on both the GCI-period score and the metric of voicing degree at the respective sample time corresponding to the respective candidate GCI;

determining a sequence of hypotheses corresponding to a least-cost path through the candidate GCIs, wherein the sequence of hypotheses includes at most one respective hypothesis associated with each candidate GCI;

backtracking through the least-cost path to determine a cost-optimal set of GCIs of the received speech signal, processing the received speech signal to derive parameters for driving a narrow-band speech encoder;

providing the derived parameters and at least one GCI of the cost-optimal set to the narrow-band speech encoder to enhance narrow-band encoding of the received speech signal; and with a transmitter, enhancing transmission of data including the encoded speech signal.

14. A system comprising:

one or more processors;

memory; and machine-readable instructions stored in the memory, that upon execution by the one or more processors cause the system to carry out operations comprising:

receiving a speech signal comprising a first temporal sequence of speech-signal samples, wherein each speech-signal sample has a sample time, processing the received speech signal to determine (i) a second temporal sequence of candidate glottal closure instants (GCIs), wherein each candidate GCI corresponds to a respective sample time in the first temporal sequence, (ii) for each respective candidate GCI of the second temporal sequence, a respective set of candidate fundamental frequencies (F0s) of the speech signal at the respective sample time corresponding to the respective candidate GCI, and (iii) for each respective candidate GCI of the second temporal sequence, a metric of voicing degree of the speech signal at the respective sample time corresponding to the respective candidate GCI, for each respective candidate GCI of the second temporal sequence, determining an objective function for each respective candidate F0 of the respective set, wherein the objective function comprises a respective hypothesis that postulates simultaneous occurrence of all three of the respective candidate GCI, the respective candidate F0, and a voicing state of the speech signal, and wherein the respective hypothesis includes a GCI-period score for a correspondence between the respective candidate F0 and a subsequent candidate GCI of the second temporal sequence, for each respective candidate GCI of the second temporal sequence, determining a cost for each respective hypothesis based, at least, on both the GCI-period score and the metric of voicing degree at the respective sample time corresponding to the respective candidate GCI, determining a sequence of hypotheses corresponding to a least-cost path through the candidate GCIs, wherein the sequence of hypotheses includes at most one respective hypothesis associated with each candidate GCI;

backtracking through the least-cost path to determine a cost-optimal set of GCIs of the received speech signal, processing the received speech signal into a sequence of phonetic units, each of the phonetic units comprising a sub-sequence of the first temporal sequence and an identifying label;

marking sample times of each phonetic unit that correspond to GCIs of the cost-optimal set;

storing each phonetic unit, including marked sample times, in a speech-synthesis database; and with a speech synthesizer device, synthesizing speech of a concatenation of stored phonetic units, the concatenation including at least one of the marked phonetic units.

15. The system of claim 14, wherein the operations further comprise:

receiving a speech signal comprising a first temporal sequence of speech-signal samples, each speech-signal sample having a sample time;

processing the received speech signal with the one or more processors to determine (i) a second temporal sequence of candidate glottal closure instants (GCIs), each candidate GCI corresponding to a respective sample time in the first temporal sequence, (ii) for each respective candidate GCI of the second temporal sequence, a respective set of candidate fundamental frequencies (F0s) of the speech signal at the respective sample time corresponding to the respective candidate GCI, and (iii) for each respective candidate GCI of the second temporal sequence, a metric of voicing degree of the speech signal at the respective sample time corresponding to the respective candidate GCI;

for each respective candidate GCI of the second temporal sequence, determining an objective function for each respective candidate F0 of the respective set, wherein the objective function comprises a respective hypothesis that postulates simultaneous occurrence of all three of the respective candidate GCI, the respective candidate F0, and a voicing state of the speech signal, and wherein the respective hypothesis includes a GCI-period score for a correspondence between the respective candidate F0 and a subsequent candidate GCI of the second temporal sequence;

for each respective candidate GCI of the second temporal sequence, determining a cost for each respective hypothesis based, at least, on both the GCI-period score and the metric of voicing degree at the respective sample time corresponding to the respective candidate GCI;

determining a sequence of hypotheses corresponding to a least-cost path through the candidate GCIs, wherein the sequence of hypotheses includes at most one respective hypothesis associated with each candidate GCI;

backtracking through the least-cost path to determine a cost-optimal set of GCIs of the received speech signal, processing the received speech signal to derive parameters for driving a narrow-band speech encoder;

providing the derived parameters and at least one GCI of the cost-optimal set to the narrow-band speech encoder to enhance narrow-band encoding of the received speech signal; and with a transmitter, enhancing transmission of data including the encoded speech signal.

16. A non-transitory computer-readable storage medium, having stored thereon program instructions that, upon execution by one or more processors of a system, cause the system to perform operations comprising:

receiving a speech signal comprising a first temporal sequence of speech-signal samples, each speech-signal sample having a sample time;

processing the received speech signal to determine (i) a second temporal sequence of candidate glottal closure instants (GCIs), wherein each candidate GCI corresponds to a respective sample time in the first temporal sequence, (ii) for each respective candidate GCI of the second temporal sequence, a respective set of candidate fundamental frequencies (F0s) of the speech signal at the respective sample time corresponding to the respective candidate GCI, and (iii) for each respective candidate GCI of the second temporal sequence, a metric of voicing degree of the speech signal at the respective sample time corresponding to the respective candidate GCI;

for each respective candidate GCI of the second temporal sequence, determining an objective function for each respective candidate F0 of the respective set, wherein the objective function comprises a respective hypothesis that postulates simultaneous occurrence of all three of the respective candidate GCI, the respective candidate F0, and a voicing state of the speech signal, and wherein the respective hypothesis includes a GCI-period score for a correspondence between the respective candidate F0 and a subsequent candidate GCI of the second temporal sequence;

for each respective candidate GCI of the second temporal sequence, determining a cost for each respective hypothesis based, at least, on both the GCI-period score and the metric of voicing degree at the respective sample time corresponding to the respective candidate GCI;

determining a sequence of hypotheses corresponding to a least-cost path through the candidate GCIs, wherein the sequence of hypotheses includes at most one respective hypothesis associated with each candidate GCI;

backtracking through the least-cost path to determine a cost-optimal set of GCIs of the received speech signal, processing the received speech signal into a sequence of phonetic units, each of the phonetic units comprising a sub-sequence of the first temporal sequence and an identifying label;

marking sample times of each phonetic unit that correspond to GCIs of the cost-optimal set;

storing each phonetic unit, including marked sample times, in a speech-synthesis database; and with a speech synthesizer device, synthesizing speech of a concatenation of stored phonetic units, the concatenation including at least one of the marked phonetic units.

17. The non-transitory computer-readable storage medium of claim 16, wherein processing the received speech signal to determine the second temporal sequence of candidate GCIs comprises:

determining linear predictive code (LPC) residuals of the speech signal, each at a respective sample time in the first temporal sequence;

determining normalized LPC residuals by normalizing a function of the LPC residuals by a root-mean-square (RMS) measure of at least a subset of the function of the LPC residuals;

identifying sub-sequences of consecutive values of the normalized LPC residuals, each sub-sequence of which has both a respective peak magnitude normalized LPC residual value that exceeds a LPC residual threshold and a respective pulse shape relative to a sample time of the respective peak magnitude normalized LPC residual value that satisfies a set of pulse-shape criteria;

determining a respective GCI-quality score for each respective identified sub-sequence based on the respective peak magnitude normalized LPC residual value and on the respective pulse shape of the respective identified sub-sequence; and for each respective identified sub-sequence, associating the respective GCI-quality score and the sample time of the respective peak magnitude normalized LPC residual with a respective one of the candidate GCIs, and wherein processing the received speech signal to determine the respective set of candidate F0s of the speech signal at the respective sample time corresponding to the respective candidate GCI comprises:

determining a linear combination of the first temporal sequence and of the LPC residuals;

determining a normalized cross-correlation function (NCCF) of the linear combination, wherein the NCCF is centered at the respective sample time corresponding to the respective candidate GCI, and computed for sample times within a time window corresponding to a range of F0 values from a minimum F0 value to a maximum F0 value;

identifying peak NCCF values of the respective NCCF that exceed a NCCF threshold value; and associating a sample time of each of the identified peak NCCF values with a respective one of the candidate F0s.

18. The non-transitory computer-readable storage medium of claim 17, wherein determining the cost for each respective hypothesis comprises:

determining a respective NCCF-peak score for the respective candidate F0 based on the peak NCCF value associated with the respective candidate F0;

merging the GCI-period score, the metric of voicing degree of the speech signal at the respective sample time corresponding to the respective candidate GCI, the respective GCI-quality score, and the respective NCCF-peak score;

if the respective candidate GCI is not the temporally-first candidate GCI of the second temporal sequence, determining a temporally prior candidate GCI based on a prior candidate F0 associated with the temporally prior candidate GCI; and if the respective candidate GCI is not the temporally-last candidate GCI of the second temporal sequence, determining a temporally subsequent candidate GCI based on the respective candidate F0, and wherein determining the sequence of hypotheses corresponding to a least-cost path through the candidate GCIs comprises:

determining a directed graph comprising all connections between candidate GCIs, wherein each of the connections corresponds to a respective period between a temporally-earlier candidate GCI and a temporally-later candidate GCI, and wherein the respective period corresponds to an inverse of the candidate F0 of a given one of the hypotheses of the temporally-earlier candidate GCI;

determining every path through the directed graph that traverses each candidate GCI at most once;

determining a respective cumulative cost of all hypotheses traversed by each determined path; and selecting the determined path corresponding to the smallest cumulative cost.

19. The non-transitory computer-readable storage medium of claim 16, wherein determining the objective function for each respective candidate F0 of the respective set comprises:

for each respective candidate F0 of the respective set, constructing a hypothesis of a concurrence of the respective candidate GCI and the respective candidate F0;

for each constructed hypothesis, determining the GCI-period score;

for each constructed hypothesis, further hypothesizing that the speech signal is in a voiced state at the respective sample time corresponding to the respective candidate GCI; and for at least one constructed hypothesis, further hypothesizing that the speech signal is in an unvoiced state at the respective sample time corresponding to the respective candidate GCI, and wherein determining the GCI-period score comprises:

determining a respective time period based on an inverse of the respective candidate F0;

determining a predicted GCI corresponding to the respective candidate F0 by adding the respective time period to the respective sample time corresponding to the respective candidate GCI; and determining a respective proximity score for the respective candidate F0 based on a temporal proximity of the predicted GCI to the subsequent candidate GCI of the second temporal sequence.

* * * * *